United States Patent [19]

Nakamura

[11] Patent Number: 4,677,347

[45] Date of Patent: Jun. 30, 1987

[54] ELECTRONIC FLASH

[75] Inventor: Hiroaki Nakamura, Hachioji, Japan

[73] Assignee: Olympus Optical, Co., Ltd., Tokyo, Japan

[21] Appl. No.: 790,537

[22] Filed: Oct. 23, 1985

[30] Foreign Application Priority Data

| | | | |
|---|---|---|---|
| Oct. 26, 1984 | [JP] | Japan | 59-226259 |
| Oct. 31, 1984 | [JP] | Japan | 59-229796 |
| Oct. 31, 1984 | [JP] | Japan | 59-229797 |
| Oct. 31, 1984 | [JP] | Japan | 59-229798 |
| Jan. 8, 1985 | [JP] | Japan | 60-1204 |
| May 10, 1985 | [JP] | Japan | 60-99362 |

[51] Int. Cl.[4] ..... H05B 37/00

[52] U.S. Cl. ..... 315/241 P; 315/209 R; 315/209 CD; 315/241 P; 315/366

[58] Field of Search ..... 315/241 P, 209 R, 209 CD, 315/360, 241 R

[56] References Cited

U.S. PATENT DOCUMENTS

| | | | |
|---|---|---|---|
| 3,496,411 | 2/1970 | Thompson | 315/241 P |
| 3,646,865 | 3/1972 | Biber | 315/241 P |
| 3,754,162 | 8/1973 | Katayama et al. | 315/241 P |

*Primary Examiner*—Harold Dixon
*Attorney, Agent, or Firm*—Louis Weinstein

[57] ABSTRACT

An electronic flash includes a main capacitor having a discharge loop in which a circuit arrangement including a flash discharge tube, a switching element and an emission controlling capacitor is connected. During the time the flash discharge tube is maintained excited, the emission controlling capacitor is either charged or discharged to cause an emission of flashlight from the flash discharge tube.

43 Claims, 25 Drawing Figures

ELECTRONIC FLASH

FIELD OF THE INVENTION AND RELATED ART STATEMENT

The invention relates to an electronic flash, and more particularly, to an electronic flash which enables a time interval from the interruption of emission of flashlight from a flash discharge tube to the initiation of a next emission to be minimized, thus permitting a multiple emission mode, an emission mode which is interlocked with a motor drive, a dynamically flat emission mode which is substantially equivalent to a prolonged continued emission of flashlight, or the like.

An electronic flash of series controlled type is disclosed, for example, in Japanese Patent Publication No. 30,905/1969, which is reproduced in FIG. 1. As shown, the circuit arrangement of this electronic flash comprises a main capacitor 1, a flash discharge tube 2, a main thyristor 3, a commutating capacitor 4, resistors 5, 6 which are used to charge the commutating capacitor 4 and a commutation thyristor 7, all of which are connected as shown.

The emission of flashlight from the discharge tube 2 is initiated in response to the turn-on of the main thyristor 3. When the emission of light, as accumulated, reaches a given value which is sufficient to provide a proper amount of exposure, the commutation thyristor 7 is turned on. The commutating capacitor 4 is previously charged through a path including the resistor 5, capacitor 4 and resistor 6, and when the thyristor 7 is turned on, the charge stored across the capacitor is effective to apply a back bias voltage across the main thyristor 3 to turn it off, thus interrupting the emission of flashlight from the discharge tube 2.

It may be desirable to effect a multiple emission of flashlight during a single shutter opening motion of a photographic camera, to take a flash photograph in interlocked relationship with a motor drive at a rate equal to several frames per second, or to provide a dynamically flat emission for flash photography in which an emission of pulse-like flashlight is repeated with a greatly reduced period therebetween so that substantially uniform exposure is produced during the time a slitwise exposure is performed by a focal plane shutter, using such an electronic flash of series controlled type. In these instances, to initiate the next emission of flashlight at a brief time interval after the interruption of a previous emission of flashlight, it is necessary that the previous emission be interrupted in a positive manner. This requires that the commutating capacitor 4 is charged beforehand.

However, it will be noted that the presence of resistors 5 and 6 stands in the way to reducing the charging time constant of the commutating capacitor 4. In addition, a certain time constant is involved in commutating the capacitor 4 through the commutation thyristor 7, thus preventing an accelerated commutation. It thus follows that the time interval from the initiation of an emission of flashlight to the initiation of next flashlight cannot be minimized. In addition, if the commutation thyristor 7 is turned on when the commutating capacitor 4 is not sufficiently charged, there occurs a failure of commutation.

A static induction (SI) thyristor is known which can be turned on and off by a bias voltage across a gate and a cathode. An electronic flash which utilizes such static induction thyristor as a main thyristor is disclosed in Japanese Laid-Open Patent Application No. 119/1978. The disclosed electronic flash has an advantage that a circuit arrangement is simplified, inasmuch as a trigger circuit associated with a static induction thyristor which is connected in series with a flash discharge tube is unnecessary, but it requires a commutation circuit including a commutating capacitor which is connected to the gate of this thyristor. Thus, the disclosed electronic flash also suffers from the disadvantage mentioned above, and additionally requires a complex gate circuit.

A flash photography which is substantially equivalent to a continuously flat emission of flashlight can be achieved by repeating a succession of pulse-like small flashlights at a reduced time interval, according to the technique as disclosed in Japanese Laid-Open Patent Application No. 222,821/1984 by the present applicant. Such electronic flash is reproduced in FIG. 2. As shown, it comprises a main capacitor 1, across which a series combination of a flash discharge tube 2 and a main thyristor 3 as well as another series combination of a rapidly charging thyristor 8 and a commutation thyristor 7 are connected. The junction between the discharge tube 2 and the main thyristor 3 is connected to the junction between the thyristors 8 and 7 through a commutating capacitor 4. The emission of flashlight is initiated from the discharge tube 2 by turning the main thyristor 3 on. Simultaneously the thyristor 8 is also turned on to charge the commutating capacitor 4 rapidly, the thyristor 8 then being turned off.

Subsequently, when the commutation thyristor 7 is turned on, the charge on the capacitor 4 back biases the anode-cathode path of the main thyristor 3, which is thus turned off to interrupt the emission of light. When the initiation and interruption of such emission is rapidly repeated during the time a slitwise exposure takes place by a focal plane shutter, the dynamically flat emission mode of the electronic flash can be achieved.

However, any slight deviation in the timing of turning the thyristors 3, 7 and 8 on and off has a great influence upon the time interval between emissions and hence upon the amount of flashlight emitted. Accordingly, an accurate timing control is required, and requires a complex circuit arrangement. In addition, the commutating capacitor 4 must have a minimum capacitance determined by the responses of the flash discharge tube 2 and the main thyristor 3 and below which a failure of commutation may result. Accordingly, the capacitance of the commutating capacitor 4 cannot be reduced, with result that there exists a lower limit in the amount of flashlight produced per emission, thus limiting a minimum time interval between successive emissions.

OBJECT AND SUMMARY OF THE INVENTION

It is an object of the invention to provide an electronic flash in which the emission of flashlight can be interrupted very rapidly and thereafter reinitiated very rapidly.

It is another object of the invention to provide an electronic flash having a simple circuit arrangement for control signals.

It is a further object of the invention to provide an electronic flash which minimizes energy loss.

According to the invention, there is no need for the provision of an emission interrupting control circuit including a commutating capacitor as required in the prior art arrangement, thus allowing a simplification in the circuit arrangement and providing a reliable circuit operation. The time interval which passes from the interruption of the emission of flashlight to the initiation of next emission can be reduced to a very small value, which is particularly effective in achieving a dynamically flat emission mode of the electronic flash.

In the arrangement of the invention, a charge which is stored across an emission controlling capacitor is utilized as a source for the emission of next flashlight, thus providing an electronic flash having a very high emission efficiency.

It is a feature of the electronic flash of the invention that a circuit including a flash discharge tube, a switching element and an emission controlling capacitor is connected in a discharge loop of a main capacitor and that the switching element is controllably turned on and off to charge or discharge the controlling capacitor while simultaneously causing an emission of flashlight from the discharge tube.

It is another feature of the electronic flash of the invention that a series circuit including a flash discharge tube, a main switching element and an emission controlling capacitor is connected in a discharge loop of a main capacitor and that the main switching element is turned on to cause an emission of flashlight while the emission of flashlight is interrupted or terminated upon completion of charging of the emission controlling capacitor.

It is a further feature of the elctronic flash of the invention that a switching element and a parallel combination of a flash discharge tube and an emission controlling capacitor are connected in a discharge loop of a main capacitor and that the emission controlling capacitor is initially charged and is then caused to be discharged through the flash discharge tube, thereby producing an emission of flashlight therefrom.

It is still another feature of the electronic flash of the invention that the charge which is stored across the emission controlling capacitor during the emission of flashlight is utilized as a source for the next emission of flashlight.

DETAILED DESCRIPTION OF PREFERRED EMBODIMENTS

The principles which are utilized in the electronic flashes of the invention will now be described with reference to the circuit diagrams of FIGS. 3 and 4. In an arrangement shown in FIG. 3, an emission of flashlight occurs as an emission controlling capacitor 11A is charged. On the contrary, an arrangement shown in FIG. 4 produces an emission of flashlight as the charge which is stored across an emission controlling capacitor 11B discharges.

Figure 1:
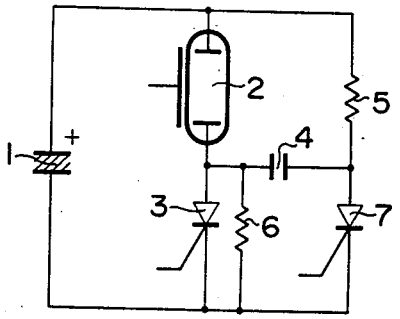
FIG. 1 is a circuit diagram of a conventional electronic flash of series controlled type.
Figure 2:
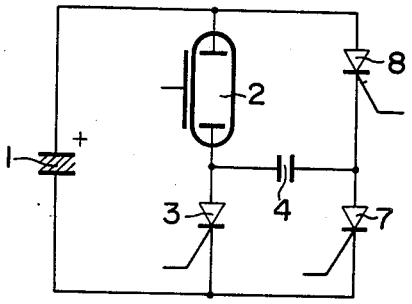
FIG. 2 is a circuit diagram of another conventional electronic flash of series controlled type in which a succession of emissions of pulse-like flashlight is rapidly repeated to provide a composite emission which is substantially equivalent to a continuous flat emission.
Figure 3:
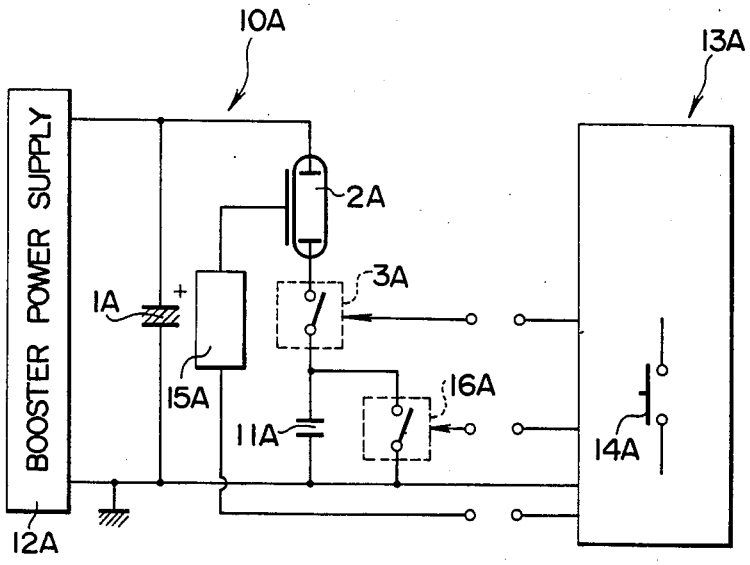
FIGS. 3 and 4 are circuit diagrams illustrating the principles which are used in the electronic flash of the invention.

Referring to FIG. 3 initially, the electronic flash shown comprises a main circuit 10A and a control circuit 13A. The main circuit 10A includes a booster power supply circuit 12A, which may comprise a well-known DC-DC converter, having a positive and a negative terminal, between which a main capacitor 1A is connected. Also connected across these terminals is a series circuit including a flash discharge tube 2A, a first switching element 3A having an on/off control terminal and a sub-capacitor or emission controlling capacitor 11A. The capacitor 11A is shunted by a second switching element 16A which has an on/off control terminal. The flash discharge tube 2A includes a trigger electrode which is connected to an output terminal of a trigger circuit 15A, an input terminal of which is connected to a first output terminal of the control circuit 13A. The control terminals of the first and the second switching element 3A, 16A are connected to a second and a third output terminal, respectively, of the control circuit 13A. The control circuit 13A may be constructed to develop given control signals in response to to an on/off condition of X-contacts 14A contained in a photographic camera, for example. The negative terminal of the power supply circuit 12A is connected to the ground and is also connected to the control circuit 13A.

In operation, as a power switch, not shown, is turned on, the main capacitor 1A is gradually charged and eventually reaches a voltage level which is sufficient to cause an emission of flashlight. When the X-contacts 14A are closed under this condition, the first and the second output terminals of the control circuit 13A deliver control signals to the main circuit 10A. Specifically, the first output terminal delivers a trigger control signal to the trigger circuit 15A, which responds thereto by developing a high voltage which is in turn applied to the trigger electrode of the discharge tube 2A, thus exciting it.

The second output terminal of the control circuit 13A delivers a gate control signal to the control terminal of the first switching element 3A, which is then turned on. Thereupon, the charge on the main capacitor 1A discharges through a first path including the positive terminal of the capacitor 1A, discharge tube 2A, the first switching element 3A, emission controlling capacitor 11A and returning to the negative terminal of the capacitor 1A, thus causing the discharge tube 2A to emit flashlight. As the flashlight is emitted in this manner, the emission controlling capacitor 11A is gradually charged, and when it is fully charged, the charging current ceases to flow, thus interrupting the emission of flashlight. In other words, in the electronic flash 1 of the type shown in FIG. 3, the emission of flashlight occurs only during the time the emission controlling capacitor is being charged, and is terminated when the charging current ceases to flow.

Figure 4:
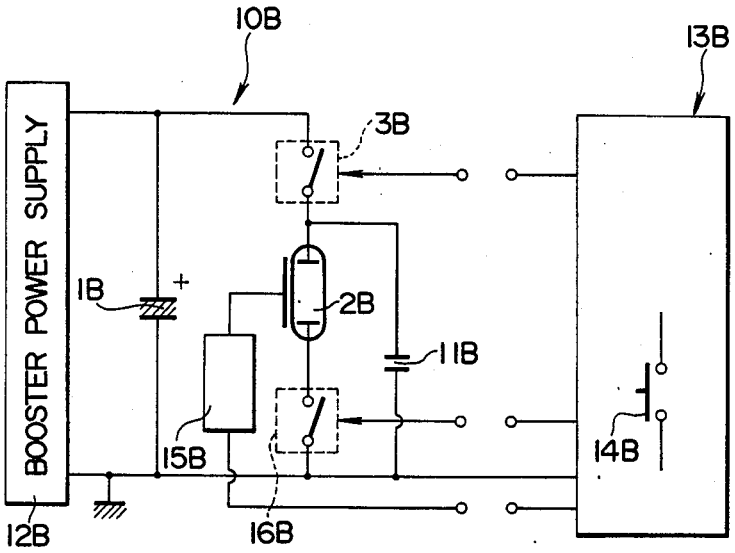

Referring to FIG. 4, the electronic flash shown includes a main circuit 10B and a control circuit 13B which includes X-contacts 14B. The main circuit 10B comprises a main capacitor 1B, a flash discharge tube 2B, a first and a second switching element 3B, 16B, a booster power supply circuit 12B, a trigger circuit 15B and a sub-capacitor or emission controlling capacitor 11B.

The electronic flash thus constructed operates as follows: When X-contacts 14B are closed under the condition that the main capacitor 1B has been charged to a given voltage level in the same manner as before, the control circuit 13B delivers a control signal to a control terminal of the first switching element 3B, thus turning it on. The emission controlling capacitor 11B is then charged through a second path starting from the positive terminal of the capacitor 1B and including the first switching element 3B, emission controlling capacitor 11B and returning to the negative terminal of the capacitor 1B.

When the control circuit 13B delivers a pair of control signals which are applied to the trigger circuit 15B and the second switching element 16B, the flash discharge tube 2B is excited in the manner as mentioned above and the second switching element 16B is turned on. Thereupon, the charge on the emission controlling capacitor 11B discharges through a third path including the positive terminal of the capacitor 11B, through the discharge tube 2B, the second switching element 16B and returning to the negative terminal of the capacitor 11B, thus causing the discharge tube 2B to emit flashlight. The magnitude of the discharge current decreases gradually as the flashlight is being emitted until the emission controlling capacitor 11B is fully discharged, whereupon the emission of flashlight is terminated. Thus, the electronic flash of the type shown in FIG. 4 operates to emit flashlight only during the time the emission controlling capacitor is discharging, and terminates the emission of flashlight when the discharge current ceases to flow.

Having described the principles of operation of the invention, an electronic flash according to a first embodiment of the invention will now be described with reference to FIGS. 5 and 6. As shown, the electronic flash comprises a main circuit 501C and a control circuit 502C. The main circuit 501C includes a booster power supply circuit 12C which converts a voltage output from a source battery to a higher voltage. One output terminal of the power supply circuit is connected to a negative bus $l_0$ while the other output terminal is connected through a rectifier diode 21C to a positive bus $l_1$. The negative bus is connected to the ground. Connected across these buses $l_1$, $l_0$ are a main capacitor 1C; a charging complete indicator circuit of known form including a resistor 22C in series with a neon lamp 23C; a trigger circuit of known form, shown as including resistors 24C, 28C, 29C, 31C, a trigger capacitor 25C, a capacitor 26C, a trigger thyristor 27C and a trigger transformer 30C, the resistor 31C being connected to receive an emission trigger signal $A_{1c}$ which is delivered from the control circuit 502C; and a series circuit including a parallel combination of a diode 33C and a coil 32C which acts to absorb impulses, a flash discharge tube 2C, a first switching element or thyristor 3C and an emission controlling capacitor 11C.

The discharge tube 2C includes a trigger electrode which is connected to a trigger output of the trigger transformer 30C while the emission controlling capacitor 11C is shunted by a second switching element or a second thyristor 38C which forms a discharge loop for the capacitor 11C. A bias resistor 37C is connected across the gate and cathode of the first thyristor 3C, and the gate of the thyristor 3C is further connected to one end of a parallel combination of a resistor 34C and a capacitor 36C, the other end of which is connected to a resistor 35C which has its other end connected to receive an emission initiate signal $A_{3c}$ which is delivered from the control circuit 502C. A bias resistor 41C is connected across the gate and cathode of the second thyristor 38C, and the gate of the thyristor 38C is further connected to one end of a parallel combination of a resistor 39C and a capacitor 42C, the other end of which is connected to a resistor 43C, the other end of which is in turn connected to receive a discharge control signal $A_{2c}$ which is delivered from the control circuit 502C.

Considering the control circuit 502C now, it includes a series circuit connected across the buses $l_1$, $l_0$ and comprising a resistor 61C, a diode 62C which assures a unidirectional flow and a resistor 63C. The junction between the cathode of the diode 62C and the resistor 63C is connected to a low voltage bus $l_2$. A capacitor 59C is connected between the buses $l_2$, $l_0$ to serve as a power supply. A series combination of resistors 57C, 58C and synchronizing contacts 14C is connected between the buses $l_2$, $l_0$, the contacts 14C being contained in a photographic camera and defined by a switch which is closed when the shutter is fully open.

The junction between the resistors 57C, 58C is connected to the base of PNP transistor 56C which has its emitter connected to the bus $l_2$ and its collector connected to the bus $l_0$ through a resistor 50C and also connected to the base of an NPN transistor 55C. The transistor 55C has its emitter connected to the bus $l_0$ and its collector connected to the bus $l_2$ through resistors 54C and 53C connected in series. The junction between the resistors 54C and 53C is connected to the bases of PNP transistors 52C, 51C. These transistors 52C, 51C have their emitters connected to the bus $l_2$. The control signal $A_{2c}$ referred to above is delivered from the collector of the transistor 52C to the main circuit 501C. The collector of the transistor 51C is connected to the bus $l_0$ through a resistor 40C in series with a parallel combination of a resistor 48C and an integrating capacitor 49C. The junction between the resistor 40C and the capacitor 49C or an integrator output is connected to the base of an NPN transistor 47C. The transistor 47C has its emitter connected to the bus $l_0$ and its collector connected to the bus $l_2$ through resistors 46C, 45C connected in series. The junction between the resistors 46C and 45C is connected to the base of a PNP transistor 44C, which has its emitter connected to the bus $l_2$ and its collector connected to deliver the emission trigger signal $A_{1c}$ and the emission initiate signal $A_{3c}$, referred to above, to the main circuit 501C.

The operation of the electronic flash thus constructed will now be described with reference to a series of timing charts shown in FIG. 6. When the synchronizing contacts 14C are closed at the same time the shutter of a camera becomes fully open, the base potential of the transistor 56C which has been maintained at a high level (hereafter referred to as H level) changes to a low level (hereafter referred to as L level), whereby the transistor 56C is turned on. This brings the base of the transistor 55C to its H level to turn it on, and the transistors 52C and 51C are also turned on. Accordingly, the collector of the transistor 52C assumes its H level, which is applied to the gate of the second thyristor 38C as the discharge control signal $A_{2c}$ mentioned above, thus turning it on. When the second thyristor 38C is turned on, any remaining charge on the emission controlling capacitor 11C instantaneously discharges through a path including the anode-cathode path of the second thyristor 38C, and the current flow through the thyristor 38C reduces below its holding current level to turn the thyristor 38C off.

The capacitor 49C begins to integrate the voltage on the bus $l_2$ at the same time the control signal $A_{2c}$ rises to its H level or when the transistor 52C is turned on. Subsequently, when the integrated voltage from the capacitor 49C exceeds thc threshold voltage across the base and emitter of the transistor 47C, which may be 0.6 V, for example, this transistor 47C is turned on. A delay time $\tau$ which is obtained until the integrated voltage exceeds the threshold value is utilized to allow the emission controlling capacitor $11_c$ to discharge. When the transistor 47C is turned on, the base of the transistor 44C assumes its L level, and this transistor becomes conductive. When the transistor 44C becomes conductive, its collector rises to its H level, which is applied to the gate of the trigger thyristor 27C as the emission trigger signal $A_{1c}$, thus turning the thyristor 27C on. When the trigger thyristor 27C is turned on, the trigger capacitor 25C which is already charged through the path starting from the bus $l_1$ and passing through the resistor 24C, the trigger capacitor 25C and the primary coil of the trigger transformer 30C and returning to the bus $l_0$ discharges therethrough, and the resulting discharge current through the primary coil of the transformer 30C develops a high voltage across the secondary coil thereof, thus triggering the discharge tube 2C.

At the same time, the first thyristor 3C is turned on by the emission initiate signal $A_{3c}$ which then rises to its H level. As the first thyristor 3C is turned on, there occurs a current flow through the path including the bus $l_1$, coil 32C, discharge tube 2C, the anode-cathode path of the first thyristor 3C, emission controlling capacitor 11C and returning to the bus $l_0$, thus initiating the emission of flashlight from the discharge tube 2C. The resulting discharge current through the discharge tube 2C also charges the emission controlling capacitor 11C, and hence the voltage thereacross begins to increase. When the magnitude of the discharge current reduces below the holding current level of the first thyristor 3C, it is turned off to terminate the emission of flashlight. Subsequently, the described operation can be repeated in response to the synchronizing contacts 14C being closed.

Figure 7:
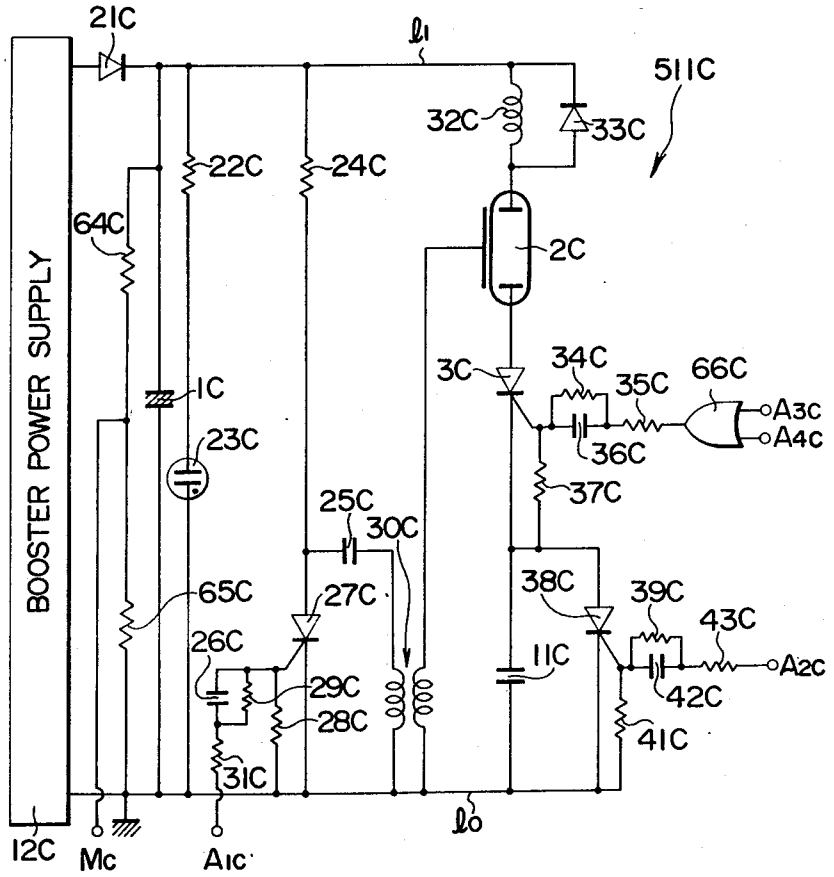
FIG. 7 is a circuit diagram of a modification of the main circuit of the electronic flash shown in FIG. 5.
Figure 8:
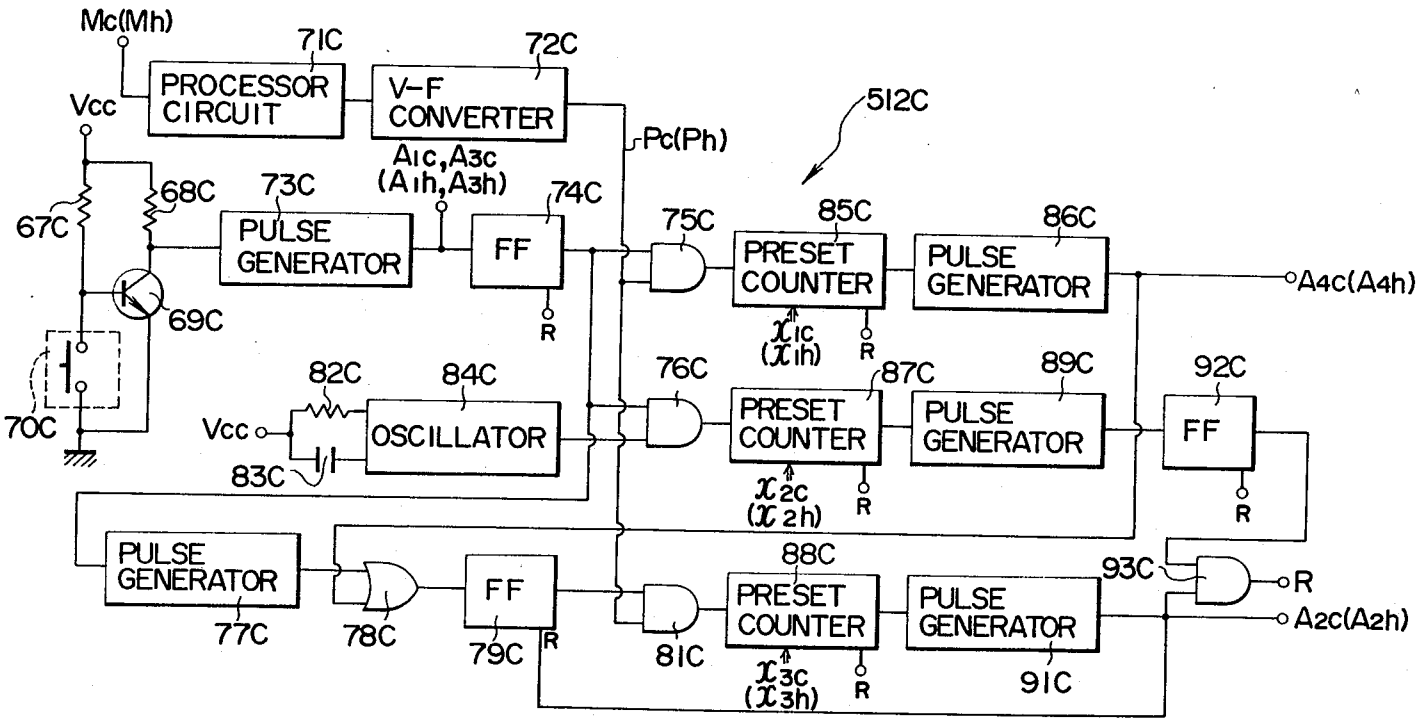
FIG. 8 is a circuit diagram of a control circuit which is adapted to be connected to the main circuit shown in FIG. 7.

Referring to FIGS. 7 and 8, there is shown a modification of the first embodiment which is adapted to establish a dynamically flat emission mode of the electronic flash. It comprises a main circuit 511C shown in FIG. 7 and a control circuit 512C shown in FIG. 8. It is to be understood that the main circuit 511C is substantially similar to the main circuit 501C shown in FIG. 5 except for certain additional parts.

Figure 5:
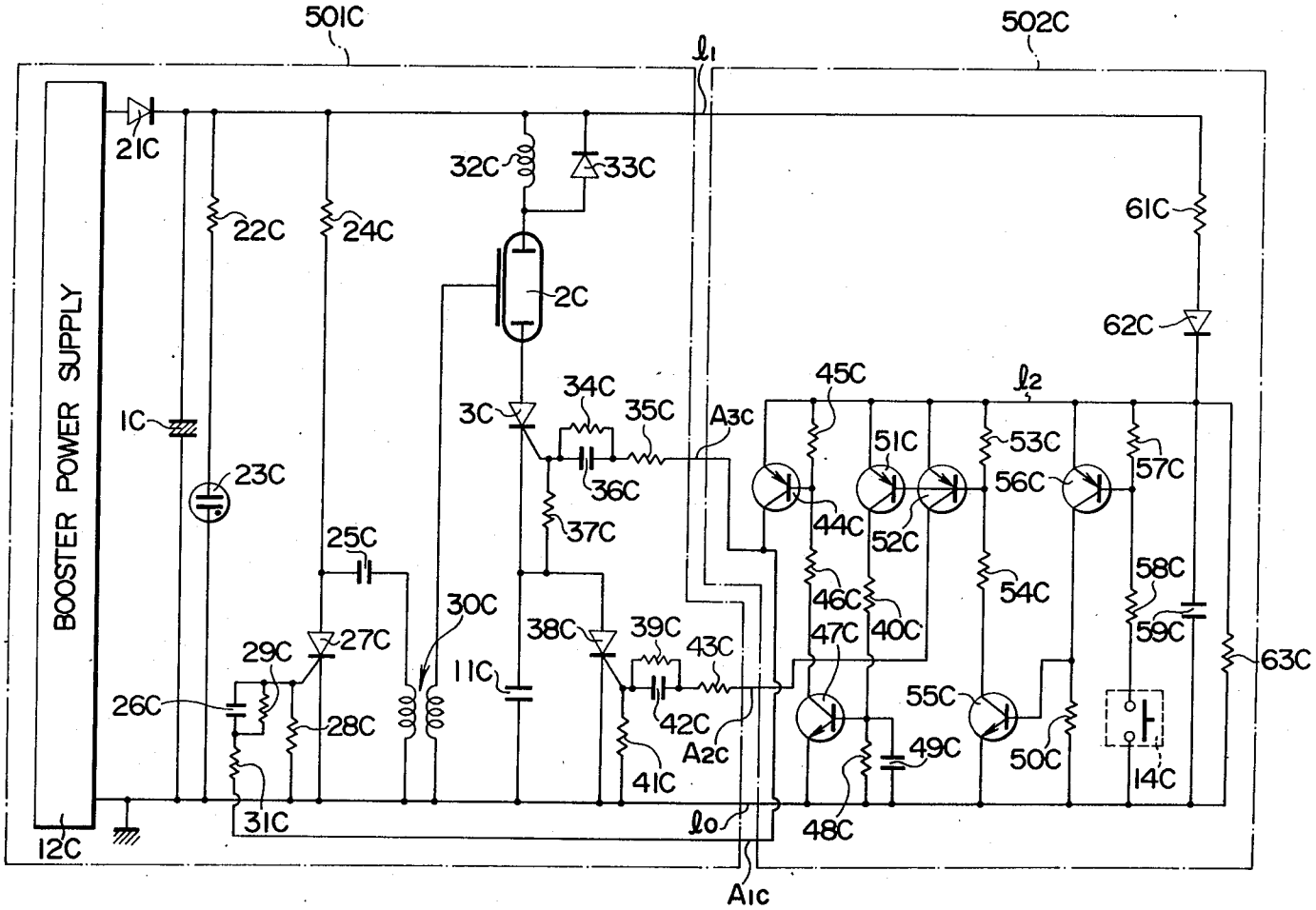
FIG. 5 is a circuit diagram of an electronic flash according to a first embodiment of the invention.
Figure 6:
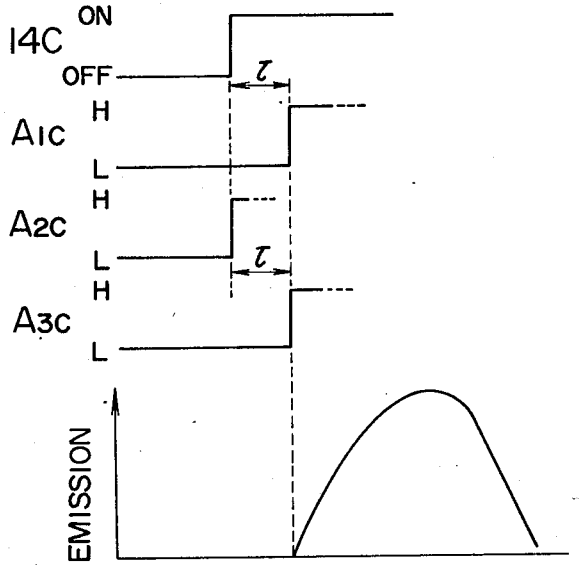
FIG. 6 graphically shows a series of timing charts which illustrate the operation of the circuit shown in FIG. 5.

Referring to FIG. 7, the main circuit 511C is modified by adding certain parts to the main circuit 501C of FIG. 5. Specifically, a voltage divider formed by resistors 64C, 65C is connected across the main capacitor 1C, with the junction between these resistors being connected to deliver a monitored voltage signal $M_c$ to the control circuit 512C. In addition, the other end of the resistor 35C which is remote from the gate of the thyristor 3C is connected to an output of an OR gate 66C which receives the emission initiate signal $A_{3c}$ and the emission reinitiate signal $A_{4c}$ delivered from the control circuit 512C as inputs thereto.

Referring to FIG. 8, the control circuit 512C of the modification includes synchronizing contacts 70C contained in a photographic camera and which is designed to provide a flat emission mode. Specifically, the synchronizing contacts 70C are formed by a switch which is closed once immediately before an image field of a film is exposed by the first blind of a focal plane shutter and which is closed again when the exposure of the film field by the first blind is completed. The synchronizing contacts 70C have one end connected to the ground while the other end is connected to one end of a resistor 67C and also to the base of an NPN transistor 69C. The other end of the resistor 67C is connected to a source of operating voltage Vcc. The transistor 69C has its collector connected to the source Vcc through a resistor 68C. The collector of the transistor 69C is also connected to the trigger input of a one-shot pulse generator (hereafter simply referred to as a pulse generator) which operates to deliver a one-shot pulse of H level in response to an input level which rises from an L to an H level. The output of the pulse generator 73C is connected to the set input of RS-flipflop (hereafter simply referred to as FF circuit) and also connected to a terminal which delivers the emission trigger signal $A_{1c}$ and the emission initiate signal $A_{3c}$. The output of FF circuit 74C feeds one input of the each of AND gates 75C, 76C and is also connected to the trigger input of a pulse generator 77C. The output of the pulse generator 77C feeds one input of an OR gate 78C, the output of which is connected to the set input of FF circuit 79C. The output of FF circuit 79C feeds one input of an AND gate 81C.

The monitored voltage signal $M_c$ from the main circuit 511C is supplied to the input of a processor circuit 71C, the output of which is applied to a voltage-to-frequency converter 72C, the output of which in turn feeds the other input of each of the AND gates 75C, 81C. The processor circuit 71C is operative to develop an output voltage which is inversely proportional to the square of a voltage across the main capacitor 1C, by initially forming the square of a divided voltage of the terminal voltage of the main capacitor 1C, as formed by the voltage divider resistors 64C, 65C, and then converting it into its reciprocal.

The other input of AND gate 76C is connected to the output of an oscillator 84C which includes a resistor 82C and a capacitor 83C, which are effective to determine the frequency of oscillation, the oscillator being fed from the source of operating voltage Vcc through the parallel combination of resistor 82C and capacitor 83C.

The output of each of the AND gates 75C, 76C, 81C is connected to the count input of respective preset counters 85C, 87C, 88C, respectively. The counter 85C operates to control the duration of a time interval between successive emissions in a dynamically flat emission mode. In order to allow the counter 85C to function in this manner, it receives preset data $x_{1c}$ which depends on an exposure period, a diaphragm value, film speed or the like and which is chosen to be less than the deionization time of the flash discharge tube 2C. The counter 87C is operative to establish an overall emission time and receives preset data $x_{2c}$ which depends on an exposure period or the like and which corresponds to a count in excess of the time duration from the beginning to the termination of the film exposure. The counter 88C operates to determine the timing of discharge of the emission controlling capacitor 11C, and receives preset data $x_{3c}$ which corresponds to a count less than the count of the preset data $x_{1c}$.

The output of each of the preset counters 85C, 87C, 88C is connected to the trigger input of pulse generators 86C, 89C, 91C, respectively. The output of the pulse generator 86C is connected to the other input of OR gate 78C and is also connected to deliver the emission reinitiate signal $A_{4c}$ to the main circuit 511C. The output of the pulse generator 89C is connected to the set input of FF circuit 92C, the output of which feeds one input of an AND gate 93C. The output of the pulse generator 91C feeds the other input of AND gate 93C, is connected to the reset terminal of the FF circuit 79C, and is also connected to deliver the discharge control signal $A_{2c}$ to the main circuit 511C. A reset signal R which is delivered from the output of the AND gate 93C is applied to the reset terminal of each of FF circuits 74C, 92C and the preset counters 85C, 87C, 88C.

Figure 9:
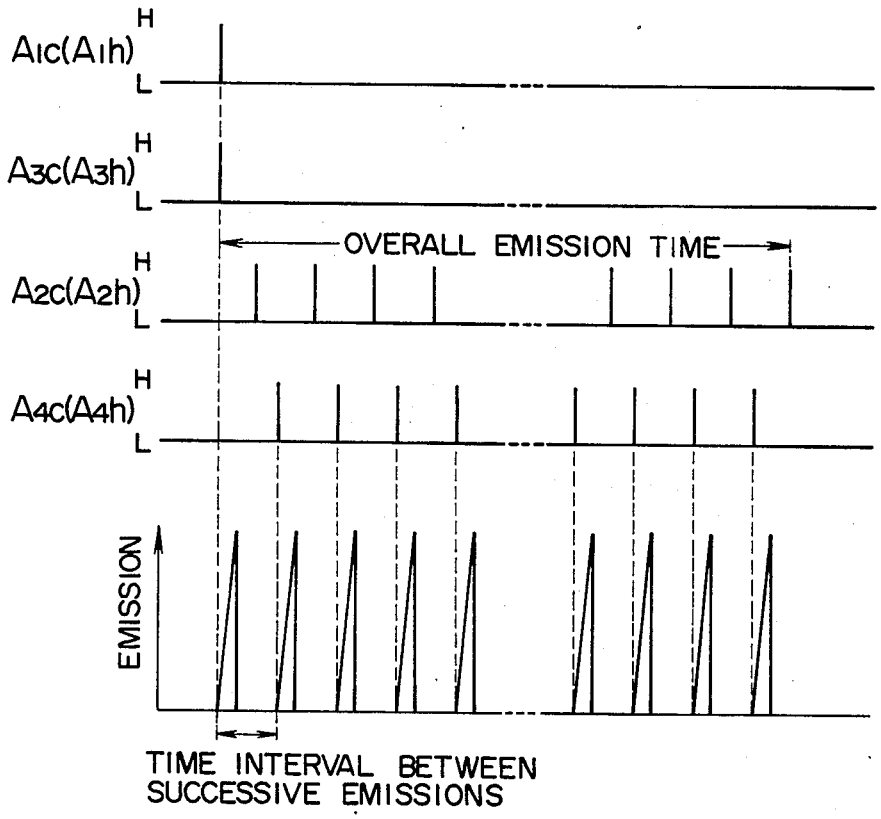
FIG. 9 graphically shows a series of timing charts which illustrate the operation of the circuits shown in FIGS. 7 and 8.

The operation of the modification thus constructed will now be described with reference to the timing charts shown in FIG. 9. When a shutter release takes place, the first blind of the focal plane shutter begins to run, thus closing the synchronizing contacts 70C. This causes the base of the transistor 69C to assume its L level, whereby it is turned off. When the transistor 69C is turned off, the signal applied to the trigger input of the pulse generator 73C rises to its H level, thus triggering the generator, which then outputs a one-shot pulse of H level. This output is applied to the gate of the trigger thyristor 27C as the emission trigger signal $A_{1c}$, thus turning it on. As the thyristor 27C is turned on, the flash discharge tube 2C is triggered into conduction in the same manner as mentioned before. Simultaneously, the H level output from the pulse generator 73C is also delivered as the emission initiate signal $A_{3c}$ to be applied to the gate of the first thyristor 3C through the OR gate 66C, thus turning it on. The emission of flashlight from the discharge tube 2C is initiated when the first thyristor 3C is turned on. At the same time, the H level output from the pulse generator 73C sets the FF circuit 74C, which thus enables the AND gates 75C, 76C. In addition, the H level output from the FF circuit 74C triggers the pulse generator 77C, which develops one-shot pulse of H level at its output. This output pulse passes through the OR gate 78C to set the FF circuit 79C, whereby the H level output of this FF circuit enables the AND gate 81C.

The voltage across the main capacitor 1C as divided by the voltage dividers 64C, 65C is fed to the processor circuit 71C as the monitored voltage signal $M_c$, and the processor circuit 71C converts it into a voltage which is inversely proportional to the square of the voltage across the main capacitor 1C. The converted voltage is then converted into a pulse signal $P_c$ having a frequency which is proportional to an input voltage by the converter 72C. The pulse signal $P_c$ is fed to the interval establishing counter 85C through the AND gate 75C and is also fed to the discharge timing controlling counter 88C through the AND gate 81C. The counter 87C, which is effective to determine an overall emission time, begins to count output pulses from the oscillator 84C.

When the discharge current through the discharge tube 2C completes charging the emission controlling capacitor 11C and reduces below the holding current level of the first thyristor 3C, the latter thyristor is turned off to interrupt the emission of flashlight. Subsequently, when the number of pulses in the pulse signal $P_c$ reaches the count established by the preset data $x_{3c}$, the output from the preset counter 88C rises to its H level. Thereupon, the pulse generator 91C is triggered, producing a one-shot pulse of H level which is applied, as the discharge control signal $A_{2c}$, to the gate of the second thyristor 38C to turn it on. Accordingly, the charge on the emission controlling capacitor 11C which has been charged by the current flow through the discharge tube 2C is instantaneously discharged through the second thyristor 38C in preparation to reinitiation of the next emission.

At the same time, the one-shot pulse of H level from the pulse generator 91C resets the FF circuit 79C, the output of which then inverts to its L level to disable the AND gate 81C, whereby the pulse signal $P_c$ ceases to be fed to the preset counter 88C.

Subsequently when the interval establishing counter 85C has counted a number of pulses in the pulse signal $P_c$ which is equal to the count corresponding to the preset data $x_{1c}$, the output of the counter 85C rises to its H level, thus resetting the counter 85C and triggering the pulse generator 86C. The generator 86C then produces a one-shot pulse of H level, which is applied, as the emission reinitiate signal $A_{4c}$, to the gate of the first thyristor 3C through the OR gate 66C, thus turning it on. When the first thyristor 3C is turned on in this manner, the emission of flashlight from the discharge tube 2C is initiated in the similar manner as mentioned before. At the same time, the one-shot pulse output of H level from the pulse generator 86C sets the FF circuit 79C through the OR gate 78C, whereby the output of the circuit 79C inverts to its H level to enable the AND gate 81C again, allowing the pulse signal $P_c$ to be fed to the counter 88C as before.

Subsequently emissions of flashlight from the flash discharge tube 2C are repeated in response to the discharge control signal $A_{2c}$ and the emission reinitiate signal $A_{4c}$ successively reaching the H level. The time interval between successive emissions is long for a high voltage and is short for a low voltage across the main capacitor 1C. In this manner, the amount of flashlight produced per emission decreases in a gradual manner as the voltage across the main capacitor 1C reduces, and hence the interval between successive emissions is gradually decreased so as to achieve a substantially constant amount of flashlight per emission.

Finally, when the number of pulses fed to the overall emission time establishing counter 87C reaches a count which corresponds to the preset data $x_{2c}$, the output from the counter 87C rises to its H level. Such output triggers the pulse generator 89C, the output of which sets the FF circuit 92C, thus enabling the AND gate 93C. Accordingly, the AND gate 93C develops the reset signal R as the discharge control signal $A_{2c}$ of H level passes therethrough, and this reset signal resets the various parts of the circuit, completing a series of emissions which constitute a dynamically flat emission mode. It should be noted that the interval between successive emissions must be chosen to be less than the deionization time of flash discharge tube 2C, or the time within which ions which are produced by the previous emission still remain within the discharge tube.

Figure 10:
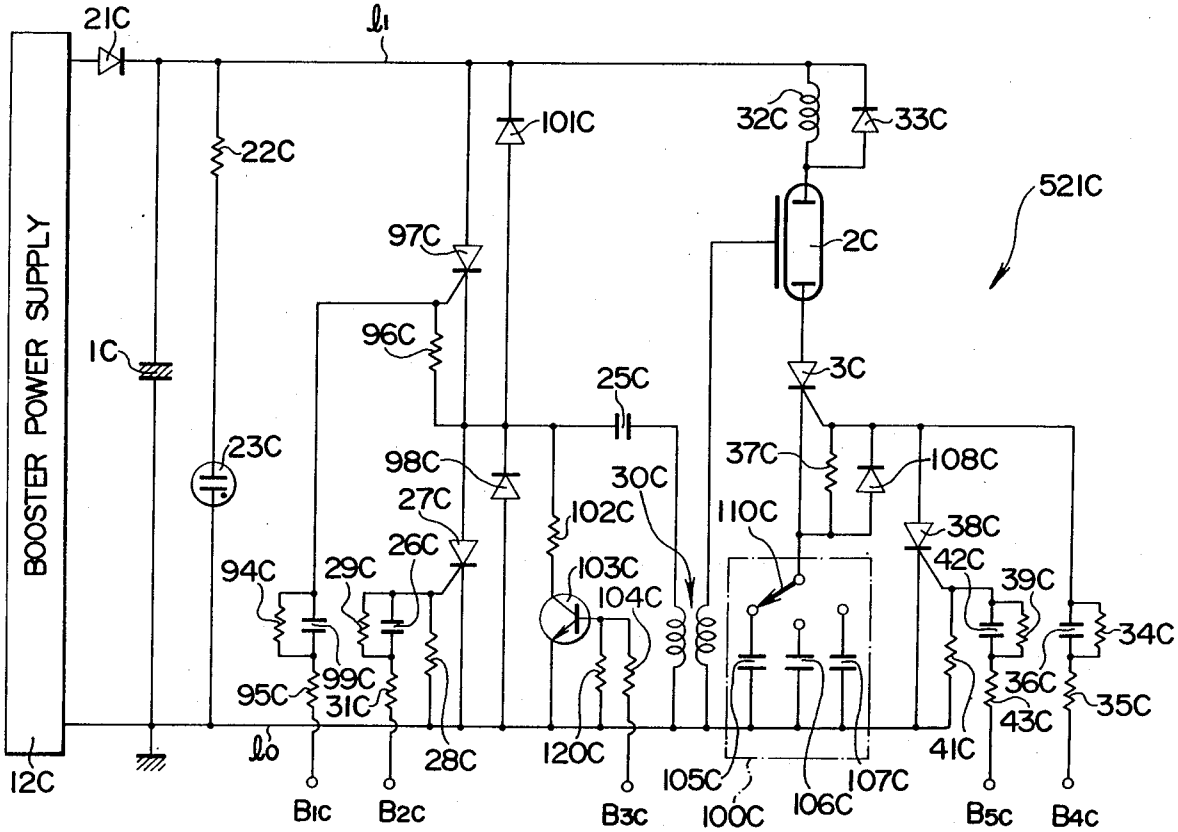
FIG. 10 is a circuit diagram of another modification of the main circuit of the electronic flash shown in FIG. 5.
Figure 11:
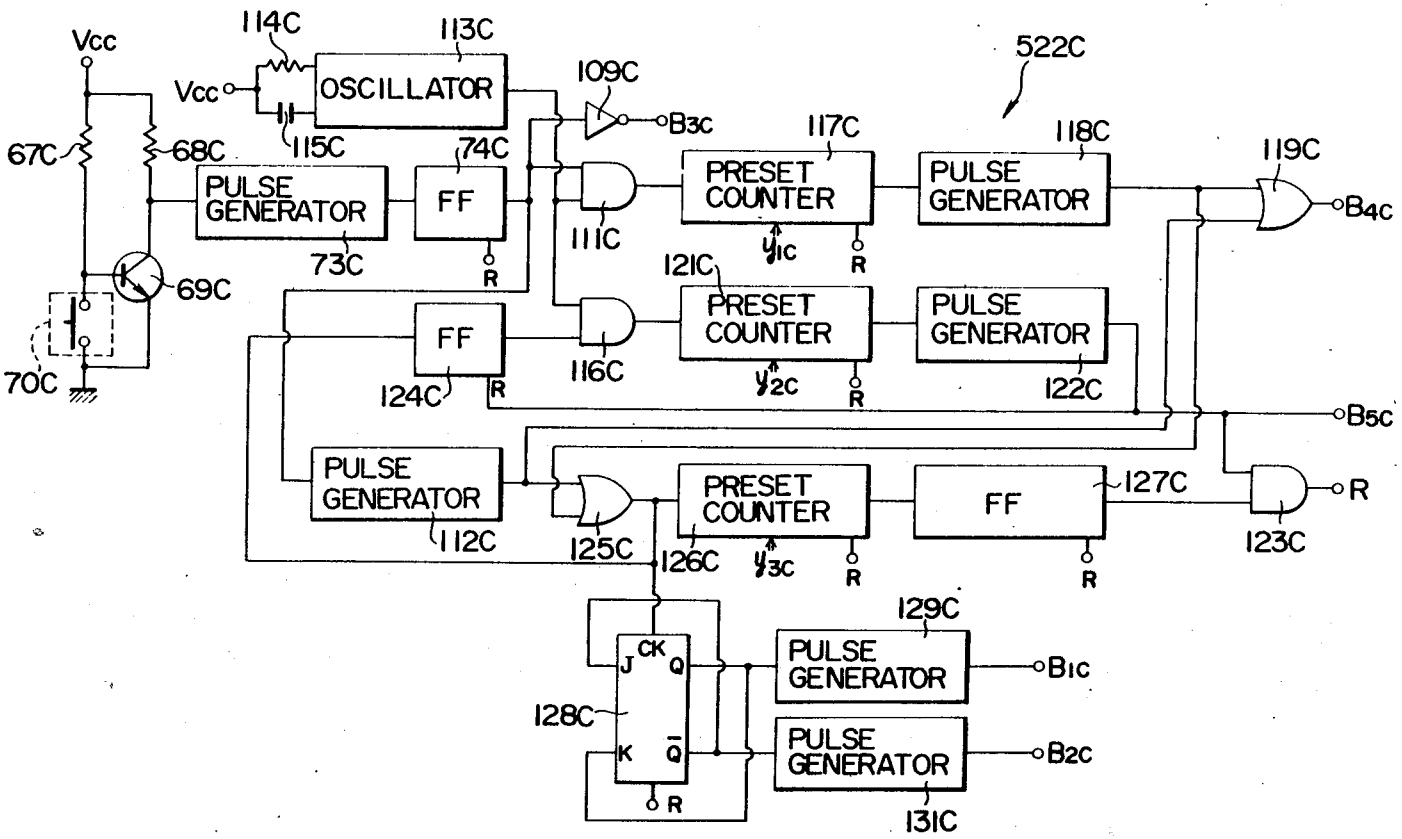
FIGS. 11 and 12 are circuit diagrams of control circuits which may be connected to the main circuit shown in FIG. 10.
Figure 12:
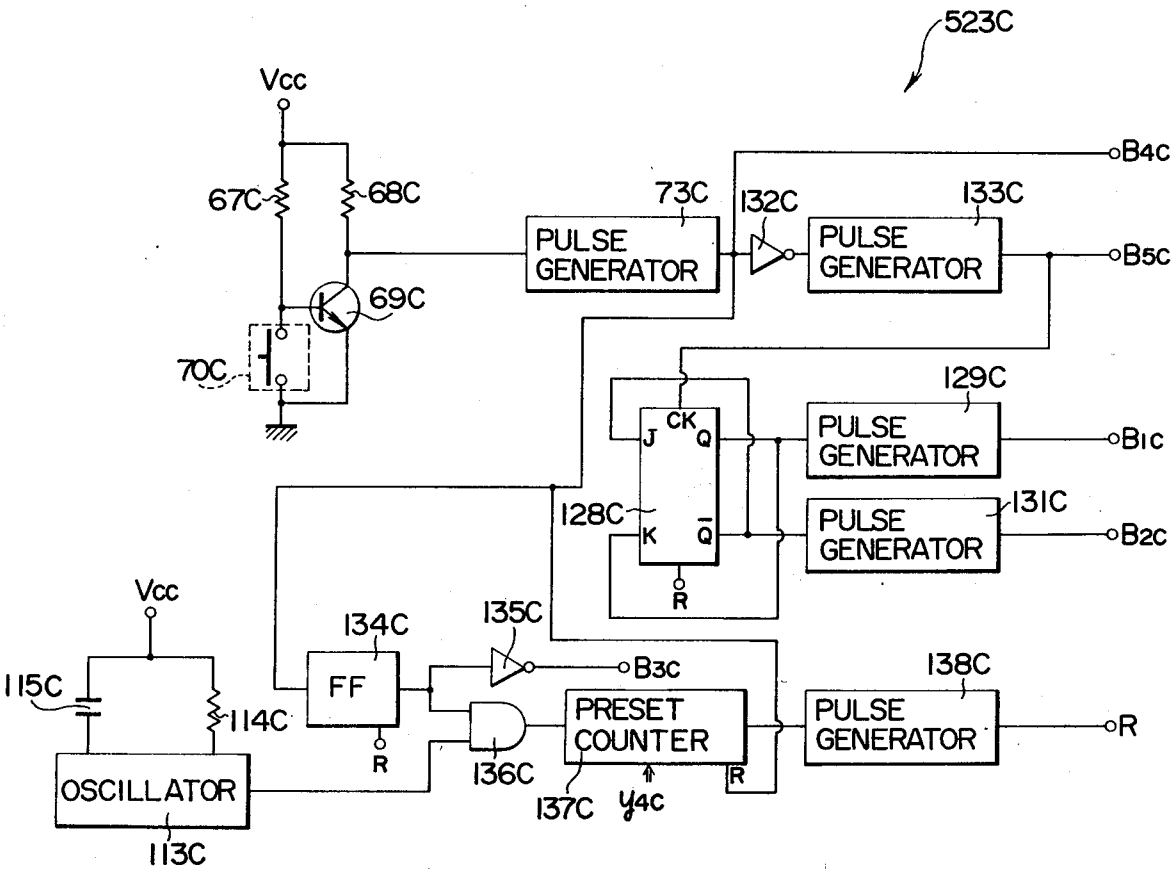

FIGS. 10 to 12 show another modification of the first embodiment shown in FIG. 5 which is constructed to provide a multiple emission mode, a dynamically flat emission mode and a motor drive interlocked mode. The modification comprises a main circuit 521C shown in FIG. 10 which is generally similar to the main circuit 502C shown in FIG. 5 with certain additional circuitry, in combination with a control circuit 522C shown in FIG. 11 which controls the main circuit 521C to enable a multiple emission mode and another control circuit 523C shown in FIG. 12 which controls the main circuit 521C to enable a dynamically flat emission mode while allowing an interlocked relationship with the motor drive.

Referring to FIG. 10 which shows the main circuit 521C, a switching circuit 100C is connected between the cathode of the first thyristor 3C and the bus $l_0$. The switching circuit 100C includes a changeover switch 110C and a plurality of emission controlling capacitors 105C, 106C, 107C having different capacitances. The gate of the first thyristor 3C is connected to the cathode of a diode 108C, the anode of which is connected to the cathode of the thyristor 3C. The anode of a thyristor 97C is connected to the bus $l_1$, and the cathode of this thyristor 97C is connected to the junction between the anode of the trigger thyristor 27C and the trigger capacitor 25C. A bias resistor 96C is connected across the gate and cathode of the thyristor 97C, and the gate of the thyristor 97C is connected through a parallel combination of a resistor 94C and a capacitor 99C in series with a resistor 95C so as to receive a first trigger control signal $B_{1c}$ which is delivered by the control circuit 522C.

A diode 98C has its cathode connected to the anode of the thyristor 27C. The cathode of the diode 98C is connected to the bus $l_0$ through a resistor 102C in series with the collector-emitter path of an NPN transistor 103C. The transistor 103C has its base connected to the bus $l_0$ through a resistor 120C and also connected through a resistor 104C to receive a third trigger control signal $B_{3c}$ which is delivered by the control circuit 522C. An emission initiate signal $B_{4c}$ which is delivered from the control circuit 522C is fed to the gate of the first thyristor 3C through a resistor 35C in series with a parallel combination of resistor 34C and capacitor 36C. A discharge control signal $B_{5c}$ which is delivered from the control circuit 522C is fed to the gate of the second thyristor 38C through a resistor 43C in series with a parallel combination of resistor 39C and capacitor 42C.

Referring to FIG. 11 which shows the control circuit 522C, an FF circuit 74C has its output connected to an input of an inverter 209C, the output of which delivers the third trigger control signal $B_{3c}$ to the main circuit 521C. The output of the FF circuit 74C also feeds one input of AND gate 111C and is also connected to the trigger input of a pulse generator 112C. The other input of AND gate 111C is connected to the output of an oscillator 113C and is also connected to one input of AND gate 116C. A resistor 114C and a capacitor 115C each have their one end connected to the oscillator 113C so as to determine the frequency of oscillation, and have their other end connected to a terminal to which the operating voltage Vcc is supplied. The output of the gate 111C is connected to the count input of a preset counter 117C. The counter 117C operates to establish a time interval between successive emissions in a multiple emission mode, and receives interval data $y_{1c}$. The output of the counter 117C is connected to the trigger input of a pulse generator 118C, the output of which is connected to one input of OR gate 119C. The output of the gate 119C delivers the emission initiate signal $B_{4c}$ to the main circuit 521C.

The output of the gate 116C is connected to the count input of a preset counter 121C, which operates to determine the timing of discharge of the emission controlling capacitors 105C, 106C, 107C. It receives discharge timing data $y_{2c}$ of a time duration which is less than the interval between successive emissions, which is established by the interval data $y_{1c}$. The output of the counter 121C is connected to the trigger input of a pulse generator 122C, the output of which feeds one input of AND gate 123C and is also connected to the reset input of an FF circuit 124C. The output of the pulse generator 122C delivers the discharge control signal $B_{5c}$ to the main circuit 521C.

The output of the pulse generator 112C is connected to one input of OR gate 125C and is also connected to the other input of OR gate 119C. The output of the gate 125C is connected to the set input of the FF circuit 124C and is also connected to the count input of a preset counter 126C. The counter 126C operates to establish the number of emissions per frame in a multiple emission mode, and receives number of emission data $y_{3c}$. The output of the counter 126C is connected to the set input of an FF circuit 127C, the output of which feeds the other input of the gate 123C. The output of the gate 123C is connected to reset terminals of the FF circuits 74C, 127C and the preset counters 117C, 121C, 126C and JK-FF circuit 128C, which will be described later.

The output of the gate 125C is connected to the clock input CK of JK-FF circuit 128C. The circuit 128C includes the K input terminal which is connected to its Q output terminal and which is also connected to the trigger input of a pulse generator 129C, thereby allowing the output of the circuit 129C to deliver the first trigger control signal $B_{1c}$ to the main circuit 521C. The JK-FF circuit 128C also includes J input terminal which is connected to its $\overline{Q}$ output terminal and which is also connected to the trigger input of a pulse generator 131C. The output of the generator 131C delivers the second trigger control signal $B_{2c}$ to the main circuit 521C.

Referring to FIG. 12 which shows the control circuit 523C, the output of the pulse generator 73C is connected through an inverter 132C to the trigger input of a pulse generator 133C, the output of which delivers the discharge control signal $B_{5c}$ to the main circuit 521C. The output of the generator 133C is also connected to the clock input of JK-FF circuit 128C.

The output of the pulse generator 73C is connected to the set input of an FF circuit 134C and also delivers the emission initiate signal $B_{4c}$ to the main circuit 521C. The output of the FF circuit 134C delivers the third trigger control signal $B_{3c}$ to the main circuit 521C, through an inverter 135C. The output of the FF circuit 134C is also connected to one input of AND gate 136C, the other input of which is connected to an output of the oscillator 113C. The gate 136C has its output connected to the count input of a counter circuit 137C. The purpose of the counter circuit 137C is to prevent a malfunctioning in the emission triggering operation in an emission mode which is interlocked with a motor drive, and receives preset data $y_{4c}$, to be described later, which corresponds to a given time interval.

The output of the counter circuit 137C is connected to the trigger input of a pulse generator 138C, the output of which delivers a reset signal R fed to the reset terminal of the FF circuit 128C and to the reset terminal of FF circuit 132C. The output of the generator 73C is also connected to the reset terminal of the counter circuit 137C.

Figure 13:
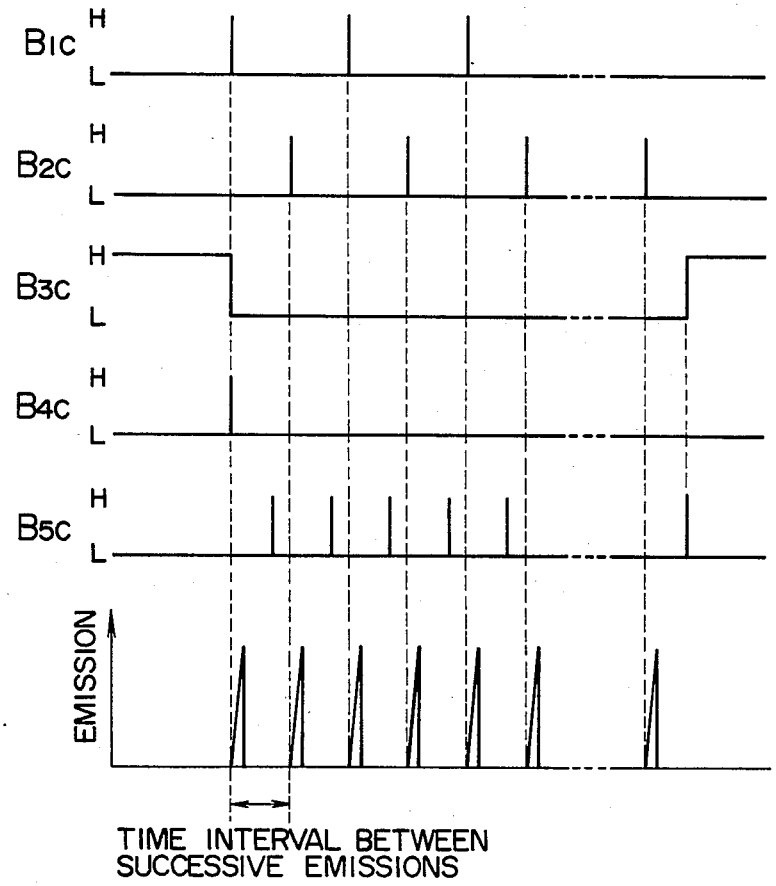
FIG. 13 graphically shows a series of timing charts which illustrate the operation of said another modification.

Considering the operation of the described modification in a multiple emission mode, the main circuit 521C shown in FIG. 10 is combined with the control circuit 522C shown in FIG. 11. Referring to FIG. 13, it will be noted that the signals $B_{1c}$, $B_{2c}$, $B_{4c}$ and $B_{5c}$ all assume their L level initially while the third trigger control signal $B_{3c}$ assumes its H level. The third trigger control signal $B_{3c}$ having the H level is applied to the base of the transistor 103C through the resistor 104C, thus turning it on to cause any residual charge on the commutating capacitor 25C to be discharged.

When the synchronizing contacts 70C are closed in response to a shutter release, the output of the FF circuit 74C changes its H level in a similar manner as mentioned above, whereupon the third trigger control signal $B_{3c}$ changes to its L level to turn the transistor 103C off. The pulse generator 112C is triggered at the same time, and produces a one-shot pulse of H level at its output. This pulse passes through the OR gate 125C to be fed to the counter 126C and to set the FF circuit 124C. The output of the FF circuit 124C then changes to its H level, thus enabling the AND gate 116C to allow output pulses from the oscillator 113C to be fed to the counter 121C, which then begins its counting operation.

At the same time, the H level output from the FF circuit 74C enables the AND gate 111C, allowing output pulses from the oscillator 113C to be fed to the counter 117C, which then begins its counting operation.

The output pulse from the pulse generator 112C passes through the OR gate 125C to be fed to the clock input of the JK-FF circuit 128C, which then develops a Q output of H level, thus causing the output of the pulse generator 129C to produce a one-shot pulse of H level which is in turn fed as the first trigger control signal $B_{1c}$ to be applied through the resistor 95C in series with the parallel combination of resistor 94C and capacitor 99C to the gate of the thyristor 97C, thus turning it on. When the thyristor 97C is turned on, there is a charging current to the trigger capacitor 25C through the path including the bus $l_1$, the anode-cathode path of the thyristor 97C, trigger capacitor 25C and the primary coil of the trigger transformer 30C and returning to the bus $l_0$, thus developing a high voltage across the secondary coil of the transformer 30C to trigger the flash discharge tube 2C. It will be seen that the thyristor 97C becomes non-conductive as the trigger capacitor 25C completes its charging.

At the same time, the H level pulse from the pulse generator 112C is fed through the OR gate 119C as the emission initiate signal $B_{4c}$ of H level to be applied through the resistor 35C in series with the parallel combination of the resistor 34C and capacitor 36C to the gate of the first thyristor 3C, thus turning it on. When the first thyristor 3C is turned on, an emission of flashlight from the discharge tube 2C is initiated in the same manner as before, and when the amount of flashlight emitted reaches a value which depends on the capacitance of either one of the emission controlling capacitors 105C, 106C or 107C, the current flow through the first thyristor 3C reduces below its holding current level to be turned off.

Subsequently, the counter 121C produces an increment output, which triggers the pulse generator 122C, allowing the output pulse of H level therefrom to be applied, as the discharge control signal $B_{5c}$, through the resistor 43C in series with the parallel combination of resistor 39C and capacitor 42C to the gate of the second thyristor 38C, thus turning it on. When the second thyristor 38C is turned on, the charge across one of the emission controlling capacitors 105C, 106C or 107C instantaneously discharges through the diode 108C and thyristor 38C in the same manner as mentioned before. Simultaneously, the output pulse of H level from the generator 122C resets the FF circuit 124C, the output of which then changes to its L level to disable the AND gate 116C.

Subsequently when the counter 117C is appropriately incremented, it develops an H level pulse at its output which triggers the pulse generator 118C, causing it to deliver a one-shot pulse of H level, which is then fed through the OR gate 119C as the emission initiate signal $B_{4c}$, thus again turning the first thyristor 3C on in the same manner as mentioned above. At the same time, the output pulse of H level from the pulse generator 118C is fed through the OR gate 125C to set the FF circuit 124C again, thus enabling the AND gate 116C. This allows the counter 121C to re-start its counting operation. Simultaneously, the H level pulse from the generator 118C is fed through the OR gate 125C to the clock input of the JK-FF circuit 128C, whereby its $\overline{Q}$ output changes to its H level. This triggers the pulse generator 131C, which then delivers a one-shot pulse of H level.

This pulse is applied as the second trigger control signal $B_{2c}$ through the resistor 31C in series with the parallel combination of resistor 29C and capacitor 26C to the gate of the trigger thyristor 27C, thus turning it on. The trigger capacitor 25C which has been charged through the thyristor 97C then discharges through the primary coil of the trigger transformer 30C, developing a high voltage across the secondary coil thereof to trigger the discharge tube 2C. At the same time, the output pulse from the generator 112C increments the counter 126C.

Successive emissions of flashlight are repeated until a given number of emissions determined by the counter 126C is reached, whereupon the counter 126C provides an output of H level. This output sets the FF circuit 127C to enable the AND gate 123C, allowing the reset signal R delivered from the gate 123C to reset the various parts of the circuit at the time the discharge control signal $B_{5c}$ rises to its H level. Accordingly, the third trigger control signal $B_{3c}$ changes to its H level to complete a series of operations in the multiple emission mode.

Considering the operation in a flashlight emission mode which is interlocked with a motor drive, the main circuit 521C shown in FIG. 10 is then combined with the control circuit 523C shown in FIG. 12. Initially, all of the signals $B_{1c}$, $B_{2c}$, $B_{4c}$ and $B_{5c}$ assume their L level while the third trigger signal $B_{3c}$ assumes its H level. Accordingly, the transistor 103C is conductive to discharge any remaining charge on the trigger capacitor 25C as mentioned previously.

When the synchronizing contacts 70C are closed in response to a first shutter release which takes place in interlocked relationship with the motor drive, the pulse generator 73C delivers a one-shot pulse of H level which is fed as the emission initiate signal $B_{4c}$ to the main circuit 521C where it turns the first thyristor 3C on, generally in the same manner as mentioned above. At the same time, the FF circuit 134C is set, whereupon the third trigger control signal $B_{3c}$ changes to its L level and accordingly the transistor 103C is turned off. As before, the first trigger control signal $B_{1c}$ then changes to its H level in the form of a pulse, and thus turns the thyristor 97C on as mentioned previously. Accordingly, the discharge tube 2C is triggered to initiate the emission of flashlight as before. Subsequently, when either one of the emission controlling capacitors 105C, 106C or 107C is completely charged, the first thyristor 3C is turned off to terminate the emission of flashlight.

Subsequently, in response to a second shutter release, the pulse generator 73C again produces a one-shot pulse of H level, whereby the $\bar{Q}$ output of the JK-FF circuit 128C changes to its H level. Thus, the second emission interrupt signal $B_{2c}$ is developed in the form of a pulse of the H level, which then turns the trigger thyristor 27C on to trigger the discharge tube 2C, as before. The emission of flashlight then takes place as mentioned previously.

It will be noted that the counter 137C is reset each time the synchronizing contacts 70C are closed and then begins its counting operation until the count reaches a value which corresponds to the preset data $y_{4c}$, whereupon the pulse generator 138C is triggered to forcibly develop the reset signal R. At that time, the third trigger control signal $B_{3c}$ is changed to its H level to cause any remaining charge on the capacitor 25C to be discharged. The purpose of this arrangement is to prevent any failure of emission of flashlight as a result of the voltage across the trigger capacitor 25C which gradually reduces by self-discharge and becomes insufficient to trigger the discharge tube 2C when the trigger thyristor 27C is turned on in the event there is a prolonged time interval between a shutter release and a next following shutter release. The related parameter can be determined depending on the responses of the trigger capacitor 25C and the discharge tube 2C.

Figure 14:
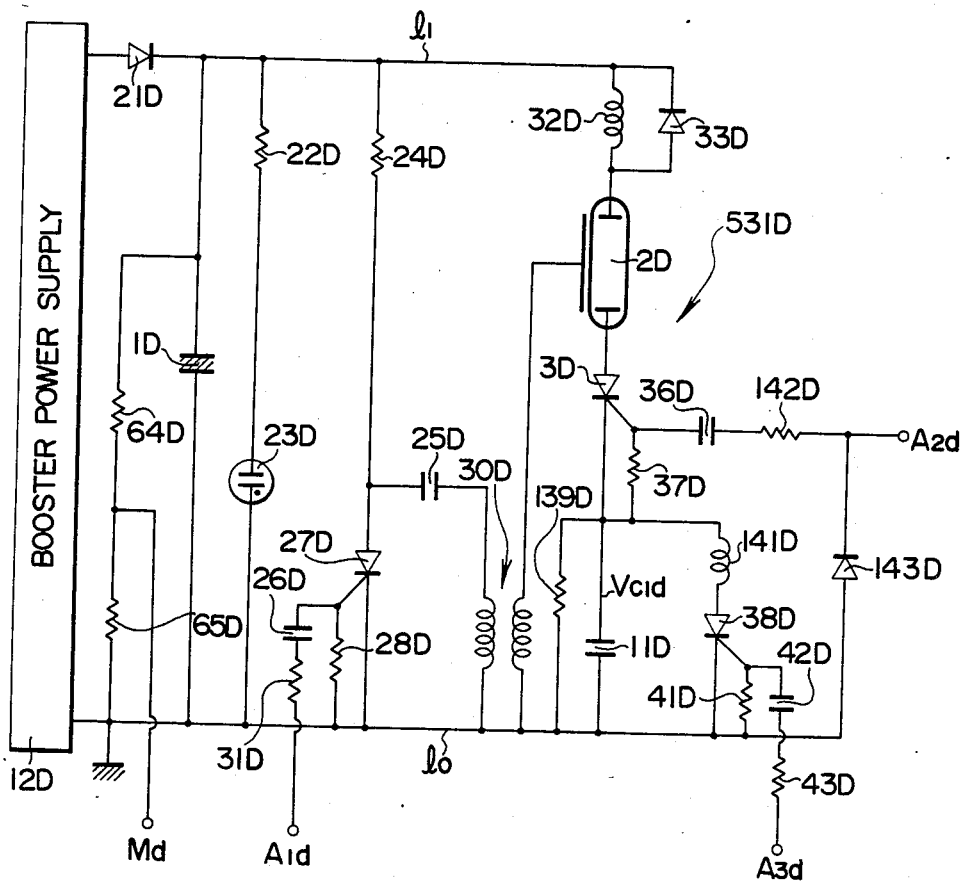
FIG. 14 is a circuit diagram of the main circuit of an electronic flash according to a second embodiment of the invention.
Figure 15:
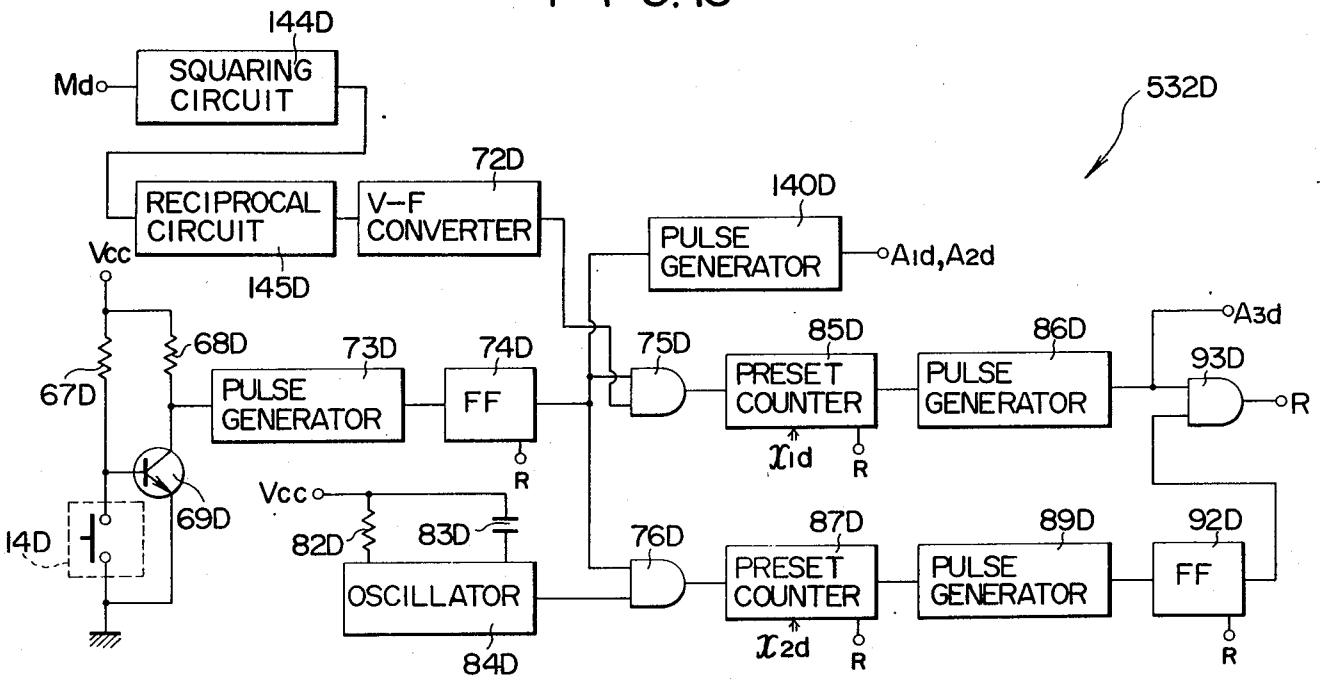
FIG. 15 is a circuit diagram of a control circuit which is connected to the main circuit shown in FIG. 14.
Figure 16:
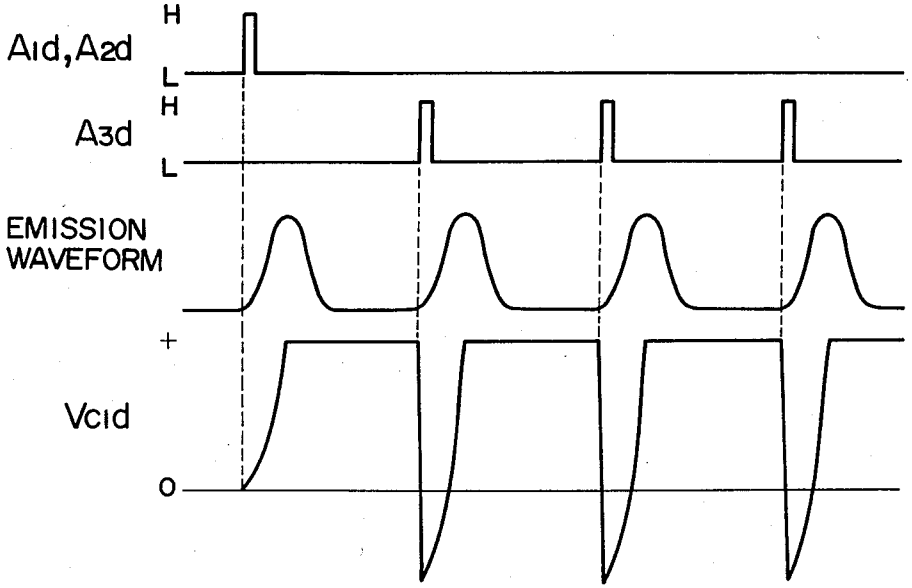
FIG. 16 graphically shows a series of waveforms which illustrate the operation of the electronic flash shown in FIG. 14.

FIGS. 14 to 16 show a second embodiment of the invention. The second embodiment includes a main circuit 531D shown in FIG. 14 and a control circuit 532D shown in FIG. 15 and connected to the main circuit 531D. FIG. 16 graphically shows a series of timing charts which illustrate the operation of this embodiment.

Referring to FIG. 14, a booster power supply circuit 12D is adapted to convert a voltage across a source battery to a higher voltage, and has its one terminal connected to a negative bus $l_0$ and its other end connected through a rectifier diode 21D to a positive bus $l_1$. A main capacitor 1D is connected across the buses $l_1$, $l_0$. A charging complete indicator circuit including a resistor 22D and a neon lamp 23D connected in series is connected across the buses $l_1$, $l_0$. A trigger circuit including resistors 24D, 28D, 31D, a trigger capacitor 25D, a capacitor 26D, a trigger transformer 30D and a trigger thyristor 27D is also connected across the buses. The resistor 31D has its other end connected to receive an emission trigger signal $A_{1d}$ which is delivered by the control circuit 532D. A voltage divider comprising resistors 64D and 65D is connected in shunt with the main capacitor 1D, with the junction between these resistors being adapted to deliver a monitored voltage signal $M_d$ which is fed to the control circuit 532D.

Also connected across the buses $l_1$, $l_0$ is a series circuit including a parallel combination of a coil 32D and diode 33D, a flash discharge tube 2D, a first thyristor 3D and an emission controlling capacitor 11D. The capacitor 11D is shunted by a resistor 139D which is effective to allow a progressive discharge of this capacitor. Also, a series combination of an inductance 141D and a second switching element or second thyristor 38D is connected in shunt with the capacitor 11D to define a discharge loop for the capacitor 11D.

A bias resistor 41D is connected across the gate and cathode of the second thyristor 38D, and the gate is also connected through a capacitor 42D in series with a resistor 43D to receive an emission reinitiate signal $A_{3d}$ which is delivered by the control circuit 532D. The gate of the first thyristor 3D is also connected to the bus $l_0$ through a capacitor 36D, a resistor and, the cathode-anode path of a diode 143D, all connected in series. The junction between the resistor 142D and the cathode of the diode 143D is fed with an emission initiate signal $A_{2d}$ delivered by the control circuit 532D. It is to be understood that the resistance of the resistor 139D is chosen sufficiently high so that the current flow through a path including the bus $l_1$, coil 32D, discharge tube 2D, the anode-cathode path of the first thyristor 3D, resistor 139D and the bus $l_0$ is less than the holding current level of the first thyristor 3D when the first thyristor 3D is turned on.

Referring to FIG. 15 which shows the control circuit 532D, synchronizing contacts 14D which are contained in a photographic camera, not shown, are formed by a switch which is closed immediately before a slitwise exposure by a focal plane shutter takes place. One terminal of the synchronizing contacts 14D is connected to the ground while the other terminal is connected through a resistor 67D to a terminal to which the operating voltage Vcc is supplied. This terminal is also connected through a resistor 68D to the collector of a transistor 69D, which has its emitter connected to the ground and its base connected to the junction between the resistor 67D and the synchronizing contacts 14D.

The collector of the transistor 69D is connected to the trigger input of a one-shot pulse generator (hereafter briefly referred to as a pulse generator) which produces a one-shot pulse of H level when it is triggered by an input signal which rises to its H level. The output of the pulse generator 73D is connected to the set input of an RS-flipflop circuit (hereafter referred to as FF circuit) 74D, the output of which in turn feeds one input of each of AND gates 75D, 76D, and also is connected to the trigger input of a pulse generator 140D. The output of the pulse generator 140D delivers the emission trigger signal $A_{1d}$ and the emission initiate signal $A_{2d}$ which are supplied to the main circuit 531D. The other input of the gate 76D is connected to the output of an oscillator 84D. The oscillator 84D has one end of a resistor 82D and a capacitor 83D connected thereto, the other end of these components being connected to a terminal to which the operating voltage Vcc is supplied. It will be understood that these resistor and capacitor elements determine the frequency of oscillation of the oscillator 84D. The other input of the gate 75D is connected to the output of a voltage-to-frequency converter 72D. The monitored voltage signal $M_d$ delivered from the main circuit 531D is supplied to the input of a squaring circuit 144D, the output of which is connected through a reciprocal circuit 145D to the input of the converter 72D. It will be seen that the squaring circuit 144D and the reciprocal circuit 145D in combination are effective to convert the monitored voltage signal $M_d$, which is equivalent to the terminal voltage across the main capacitor 1D as divided by the voltage dividers 64D, 65D, into a squared form, which is then converted into its reciprocal. In other words, an output voltage which is inversely proportional to the square of the voltage across the main capacitor 1D is formed.

The outputs of the gates 75D, 76D are connected to the count input of each of preset counters 85D, 87D, respectively. The preset counter 85D is effective to control a time interval between the initiation of an emission of flashlight to the initiation of next emission of flashlight in a dynamically flat emission mode. Accordingly, preset data $x_{1d}$ which is determined in accordance with an exposure period, a diaphragm value, film speed, etc., and corresponding to a time less than the deionization time of the discharge tube 2D is supplied to this counter. On the other hand, the preset counter 87D is supplied with preset data $x_{2d}$ which is determined in accordance with an exposure period, etc., and which represents a count corresponding to an overall emission time which is greater than the time interval from the initiation to the termination of a film exposure.

The output of the counter 85D is connected to the trigger input of a pulse generator 86D, the output of which feeds one input of AND gate 93D. The output of the pulse generator 86D also delivers the emission reinitiate signal $A_{3d}$ which is fed to the main circuit 531D. The output of the counter 87D is connected to the trigger input of a pulse generator 89D, the output of which is connected to the set input of an FF circuit 92D, the output of which is in turn connected to the other input of the gate 93D. The output of the gate 93D delivers a reset signal R which is fed to the reset input of each of the FF circuits 74D, 92D and the counters 85D, 87D.

The operation of the second embodiment described above will now be described with reference to a series of timing charts shown in FIG. 16. When the synchronizing contacts 14D are closed in response to a shutter release, the base potential of the transistor 69D which has been maintained at its H level by the resistor 67D changes to its H level, whereby it is turned off. This allows the collector of the transistor 69D to rise to its H level, allowing the pulse generator 73D to be triggered to set the FF circuit 74D, thus enabling the gates 75D, 76D. At the same time, the counter 85D begins counting output pulses from the converter 72D, and the counter 87D begins counting output pulses from the oscillator 84D.

Simultaneously, the H level output from the FF circuit 74D triggers the pulse generator 140D, which produces a one-shot pulse of H level at its output. This pulse is fed as the emission trigger signal $A_{1d}$ to turn the trigger thyristor 27D in the main circuit 531D on, and is also fed as the emission initiate signal $A_{2d}$ to turn the first thyristor 3D on. Accordingly, a high voltage trigger signal is applied to the flash discharge tube 2D, thus exciting it. At the same time, the discharge current through the discharge tube 2D charges the emission controlling capacitor 11D, and the voltage Vc1d thereacross increases gradually to initiate the emission of flashlight. The emission continues until a charging operation of the capacitor 11D is completed. It will be appreciated that the capacitor 11D is initially discharged by the resistor 139D.

Subsequently, when the count in the counter 85D reaches a value which corresponds to the preset data $x_{1d}$, it develops a one-shot pulse of H level at its output. This triggers the pulse generator 86D, which develops a one-shot pulse of H level at its output. This pulse is applied as the emission reinitiate signal $A_{3d}$ to the gate of the second thyristor 38D, thus turning it on. Thereupon the charge across the emission controlling capacitor 11D discharges through a discharge loop including the inductance 141D, the anode-cathode path of the second thyristor 38D and the bus $l_0$. When the discharge current reduces below the holding current level of the second thyristor 38D, it is turned off. As such discharge occurs, a back electromotive force is developed across the inductance 141D, which biases the cathode of the first thyristor 3D to a high negative voltage, allowing a current flow through a path including the emission controlling capacitor 11D, bus $l_0$, the anode-cathode path of the diode 143D, resistor 142D, capacitor 36D, resistor 37D and returning to the capacitor 11D. Accordingly, a trigger current flows into the gate of the first thyristor 3D to turn it on again. As the thyristor 3D is turned on, the emission of flashlight is initiated again in the same manner as mentioned before. Thus the emission initiate signal $A_{2d}$ causes an initial emission, and subsequently the emission reinitiate signal $A_{3d}$ causes a discharge of the emission controlling capacitor 11D, and simultaneously the first thyristor 3D is turned on to reinitiate the emission of flashlight.

Subsequently, an emission of flashlight from the discharge tube 2D is repeated each time the emission reinitiate signal $A_{3d}$ in the form of one-shot pulse of H level is produced. The time interval between successive emissions is long for a high voltage across the main capacitor 1D and is short for a reduced voltage across the capacitor 1D. In other words, as the voltage across the main capacitor 1D decreases and correspondingly the amount of flashlight produced per emission decreases gradually, the time interval between successive emissions is gradually shortened so that a substantially uniform amount of emission is maintained.

When the number of pulses fed to the counter 87D which controls the total emission time reaches a value which corresponds to the preset data $x_{2d}$, it develops an output of H level. This output triggers the pulse generator 89D, which in turn sets the FF circuit 92D to enable the gate 93D. When the emission reinitiate signal $A_{3d}$ in the form of a one-shot pulse of H level passes through the gate 93D, the reset signal R is developed at the output of the gate 93D and fed to various parts of the circuit to reset them, thus terminating a series of emissions which constitute a dynamically flat emission mode.

Figure 17:
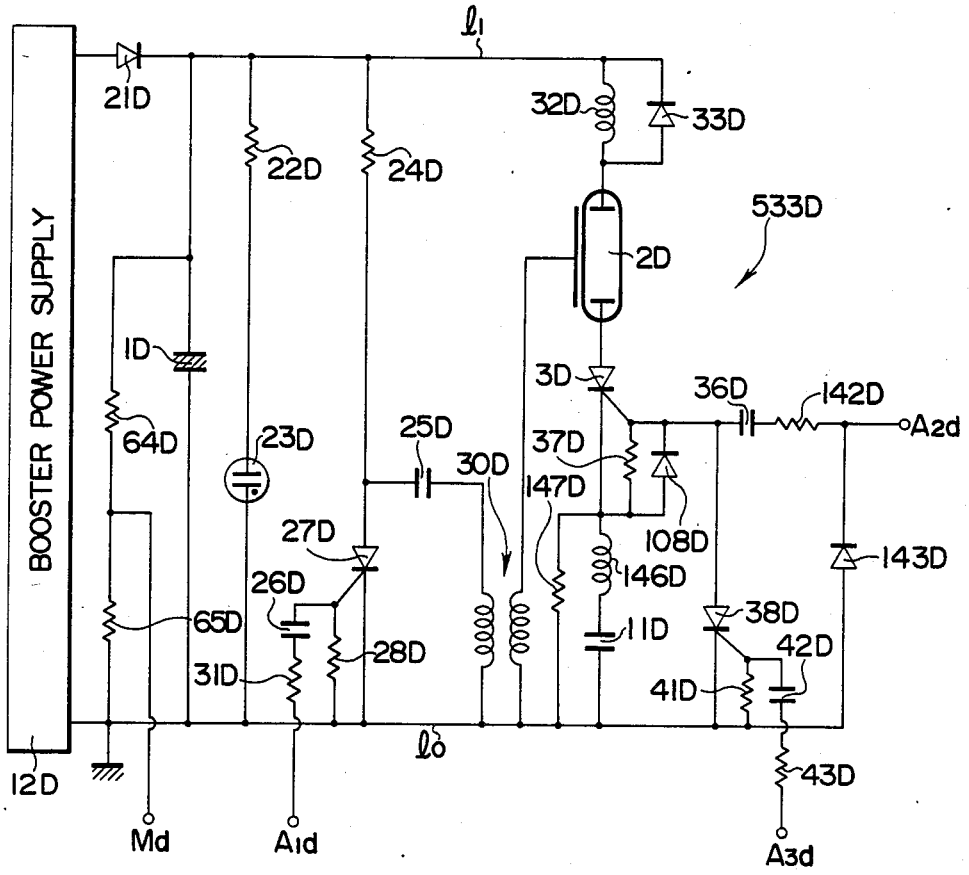
FIG. 17 is a circuit diagram of a modification of the main circuit shown in FIG. 14.

FIG. 17 shows a modification of the main circuit 531D shown in FIG. 14. A main circuit 533D shown in FIG. 17 is generally similar to the main circuit 531D shown in FIG. 14 except that an emission controlling capacitor 11D has its one end connected to the bus $l_0$ has its other end connected to an inductance 146D, the other end of which is connected to the cathode of the first thyristor 3D and that the gate of the first thyristor is connected to the cathode of a diode 108D, the anode of which is connected to the cathode of the first thyristor 3D.

Considering the operation of the main circuit 533D, when the emission reinitiate signal $A_{3d}$ turns the second thyristor 38D on, the emission controlling capacitor 11D which is previously charged discharges through a discharge loop including the inductance 146D, the anode-cathode path of the diode 108D, the anode-cathode path of the thyristor 38D and the bus $l_0$. Thus the diode 108D is effective to back bias the cathode-gate path of the first thyristor 3D, allowing the first thyristor 3D to be turned off in a positive manner. When the discharge current reduces below the holding current level of the second thyristor 38D, it is turned off. During the discharge, a back electromotive force is developed across the inductance 146D which biases the cathode of the first thyristor 3D to a high negative voltage, allowing a current flow through a path including the emission controlling capacitor 11D, the bus $l_0$, the anode-cathode path of the diode 143D, resistor 142D, capacitor 36D, resistor 37D, the inductance 146D and returning to the capacitor 11D. This results in a trigger current which flows into the gate of the first thyristor 3D to turn it on, thus reinitiating the emission of flashlight. Subsequently, successive emissions are repeated in a manner mentioned above to achieve an operation in a dynamically flat emission mode.

Figure 18:
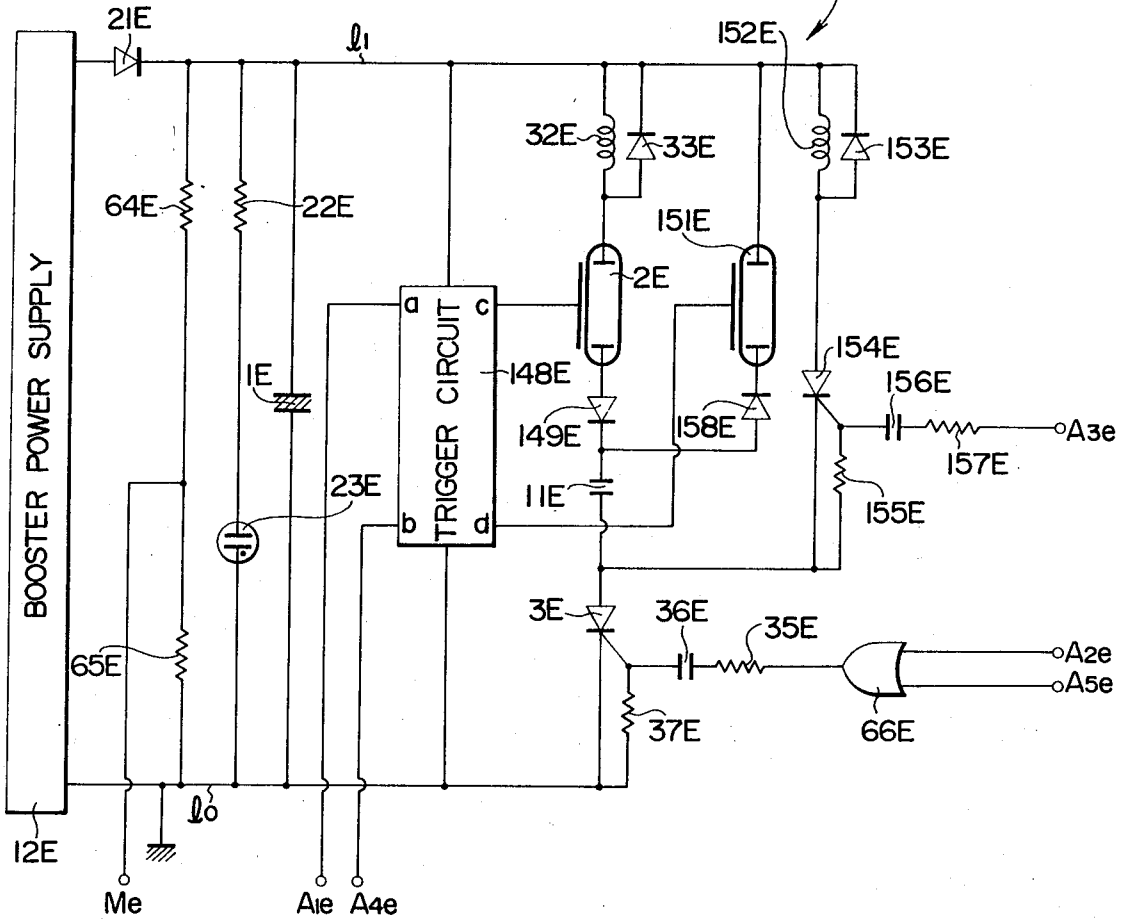
FIG. 18 is a circuit diagram of the main circuit of an electronic flash according to a third embodiment of the invention which includes a pair of flash discharge tubes.
Figure 19:
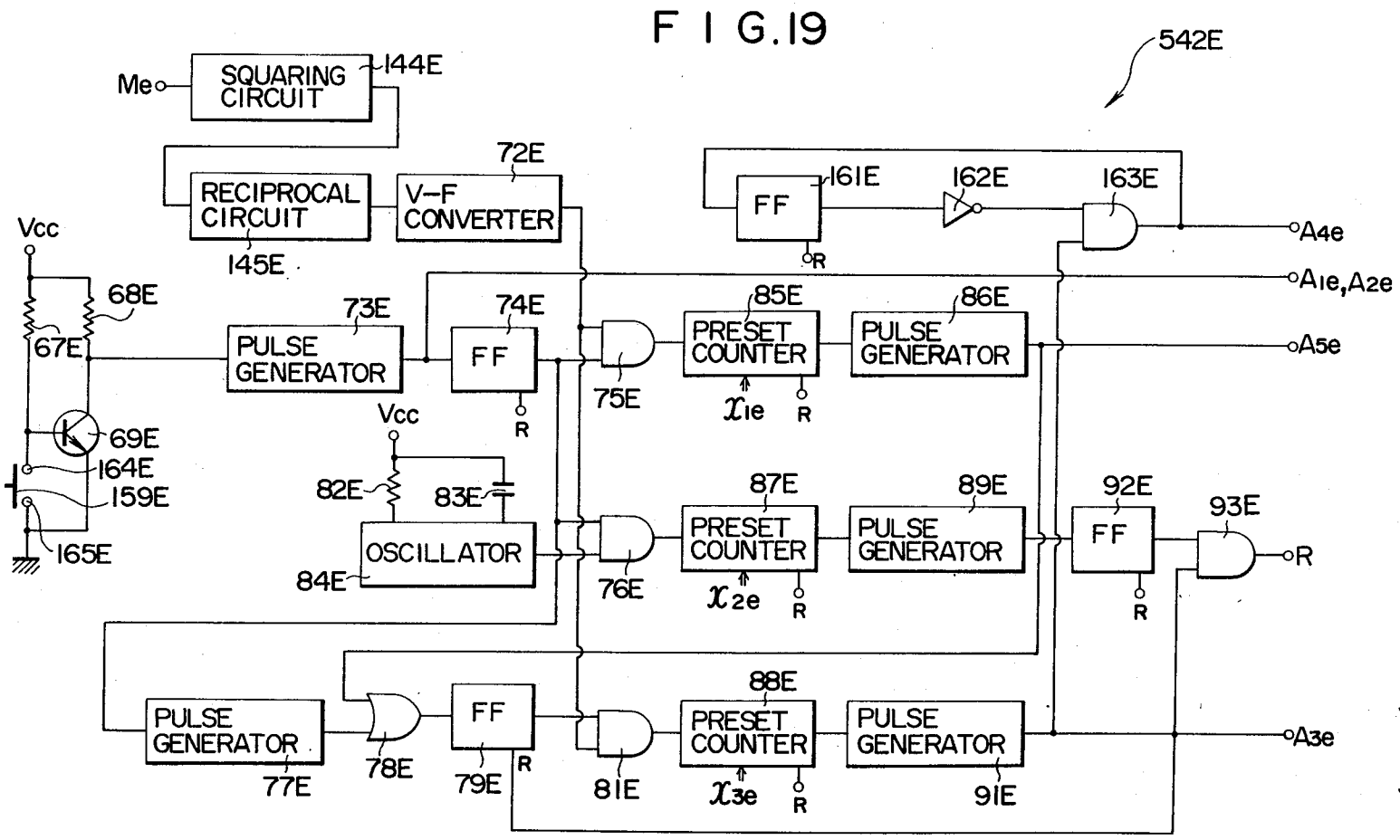
FIG. 19 is a circuit diagram of a control circuit which is connected to the main circuit shown in FIG. 18.

A third embodiment of the invention is shown in FIGS. 18 and 19. Specifically, this embodiment comprises a main circuit 541E shown in FIG. 18 and a control circuit 542E shown in FIG. 19. It will be noted that in the first embodiment mentioned above, the charge which is stored across the emission controlling capacitor is merely discharged and is not positively utilized. However, the third embodiment as well as a fourth embodiment to be described later positively utilizes the charge across the emission controlling capacitor as a source of energy to be used in the next emission of flashlight.

Referring to FIG. 18, a booster power supply circuit 12E which may comprise a DC-DC converter of well-known form has its positive terminal connected through a rectifier diode 21E to a positive bus $l_1$ and has its negative terminal connected to a negative bus $l_0$, which is connected to the ground.

A voltage divider comprising resistors 64E, 65E is connected across the buses $l_1$, $l_0$, and the junction between these resistors is connected to the control circuit 542E shown in FIG. 19 so as to deliver a charged voltage signal $M_e$ representing the voltage across a main capacitor 1E. A charging complete indicator circuit is connected across the buses $l_1$, $l_0$ and comprises a series combination of a resistor 22E and a neon lamp 23E. When the main capacitor 1E connected across the buses $l_1$, $l_0$ is charged to a given voltage, the neon lamp 23E is lit.

One end of a coil 32E and the cathode of a diode 33E are connected to the bus $l_1$, and the other end of the coil 32E and the anode of the diode 33E are connected together and connected to one electrode of a first flash discharge tube 2E. The other electrode of the discharge tube 2E is connected through the anode-cathode path of a diode 149E to one end of an emission controlling capacitor 11E, the other end of which is connected to the anode of a first main thyristor 3E and to the cathode of a second main thyristor 154E. The junction between the cathode of the diode 149E and the capacitor 11E is connected through the anode-cathode path of a diode 158E to one electrode of a second flash discharge tube 151E having its other electrode connected to the bus $l_1$. The first main thyristor 3E has its cathode connected to the bus $l_0$ and its gate connected through a resistor 37E to the bus $l_0$ and also connected through a series combination of a capacitor 36E and a resistor 35E to the output of an OR gate 66E. The gate 66E has a first input to which an emission initiate signal $A_{2e}$ is delivered from the control circuit 542E to cause a first emission of flashlight is fed, and a second input to which an emission initiate signal $A_{5e}$ which causes a third and a subsequent odd-numbered emission of flashlight is fed.

The anode of the second main thyristor 154E is connected to the bus $l_1$ through a parallel combination of a coil 152E and a diode 153E. The gate of the thyristor 154E is connected to the cathode thereof through a resistor 155E and also connected through a series combination of a capacitor 156E and a resistor 157E to receive an emission initiate signal $A_{3e}$ delivered from the control circuit 542E and which causes a second and a subsequent even-numbered emission of flashlight.

Also connected across the buses $l_1$, $l_0$ are the first and second inputs of a trigger circuit 148E which develops a high voltage for application to trigger electrodes of the first and second flash discharge tubes 2E, 151E. The trigger circuit 148E also includes a third input a and a fourth input b, which are connected to receive a trigger electrode signal $A_{1e}$ which causes a trigger voltage to be applied to the first flash discharge tube 2E and a trigger electrode signal $A_{4e}$ which causes a trigger voltage to be applied to the second flash discharge tube 151E, respectively, both delivered by the control circuit 542E. The first output terminal c of the trigger circuit 148E is connected to the trigger electrode of the first flash discharge tube 2E while the second output terminal d is connected to the trigger electrode of the second flash discharge tube 151E.

The main circuit 541E operates as follows: When a power switch, not shown, is turned on, the main capacitor 1E begins to be charged, and when it is charged to a given voltage, the neon lamp 23E is lit. If the trigger electrode signal $A_{1e}$ and the emission initiate signal $A_{2e}$ are delivered from the control circuit 542E under this condition, the signal $A_{1e}$ is applied to the third input a of the trigger circuit 148E, whereupon a trigger voltage is developed at the first output terminal c of the trigger circuit 148E to be applied to the trigger electrode of the first flash discharge tube 2E, thus exciting it.

On the other hand, the emission initiate signal $A_{2e}$ is applied to the first input of the gate 66E, and thence through the series combination of the resistor 35E and capacitor 36E to the gate of the first main thyristor 3E, thus turning it on. Accordingly, there occurs a current flow through a path $L_{1e}$ including the bus $l_1$, coil 32E, first discharge tube 2E, diode 149E, capacitor 11E and the first main thyristor 3E and returning to the bus $l_0$. It will be understood that this current flow charges the capacitor 11E, and has a magnitude which decreases gradually as the capacitor 11E is increasingly charged. When the current flow reduces below the holding current level of the first main thyristor 3E, the latter is turned off, whereby the current flow is interrupted and the first flash discharge tube 2E ceases its emission of flashlight. When the control circuit 542E then delivers the trigger electrode signal $A_{4e}$ which is applied to the fourth input terminal b of the trigger circuit 148E, a trigger voltage is applied to the second flash discharge tube 151E in a similar manner as mentioned above, thus exciting it. On the other hand, the emission initiate signal $A_{3e}$ is applied through the series combination of resistor 157E and capacitor 156E to the gate of the second main thyristor 154E, thus turning it on. Then the capacitor 11E which has been charged in the manner mentioned above discharges through a path including the capacitor 11E, the diode 158E, the second flash discharge tube 151E, the coil 152E, the second main thyristor 154E and returning to the negative terminal of the capacitor 11E (hereafter referred to as a path $L_{2e}$), causing the second flash discharge tube 151E to emit flashlight. This discharge current also decreases in a gradual manner, and when it reduces below the holding current level of the second main thyristor 154E, the latter is turned off, whereby the second flash discharge tube 151E ceases to emit flashlight.

If the emission initiate signal $A_{5e}$ is applied within a deionization time during which ions produced by the discharge process remain within the first flash discharge tube 2E after the termination of emission of flashlight therefrom, the application of the signal $A_{5e}$ to the gate of the first main thyristor 3E through the gate 66E, the resistor 35E and the capacitor 36E turns the thyristor 3E on again. The application of this signal within the deionization time means that the application of a forward voltage across the first flash discharge tube 2E is sufficient to cause the current flow through the path $L_{1e}$ without requiring the application of a high voltage to the trigger electrode thereof, thus causing the discharge tube 2E to emit flashlight. The emission of flashlight is terminated when the capacitor 11E is fully charged.

On the other hand, if the emission initiate signal $A_{3e}$ is applied within the deionization time of the second flash discharge tube 151E since the termination of the previous emission of flashlight therefrom, the second main thyristor 154E is turned on to produce the current flow through the path $L_{2e}$ mentioned above, causing the second flash discharge tube 151E to emit flashlight again. Subsequently, the described operations are repeated wherein the first and the second flash discharge tube 2E, 151E repeatedly emit flashlight in an alternate fashion until the cessation of the emission initiate signals $A_{3e}$ and $A_{5e}$ delivered from the control circuit 542E, whereupon the emission of flashlight is interrupted.

Referring to FIG. 19 which shows the control circuit 542E, the arrangement and operation of the control circuit will now be considered. Specificially, a switch 159E which is mounted in a photographic camera, not shown, and which is used to initiate a dynamically flat emission mode in response to the beginning of a film exposure or the beginning of running of a first blind of a shutter has its first fixed contact 165E connected to the ground by connection to the bus $l_0$ and has its second fixed contact 164E connected to the base of an NPN transistor 69E and also connected through a resistor 67E to a terminal to which the operating voltage Vcc is supplied. The transistor 69E has its emitter connected to the bus $l_0$ and its collector connected through a resistor 68E to the terminal to which the operating voltage Vcc is supplied, and also connected to the input of a one-shot pulse generator 73E (hereafter simply referred to as a pulse generator) which is adapted to develop a one-shot pulse of H level. The output of the pulse generator 73E is connected to the input of a flip-flop circuit or FF circuit 74E and is also connected to deliver the trigger electrode signal $A_{1e}$ and the emission initiate signal $A_{2e}$ to the main circuit 541E. The output of the FF circuit 74E feeds one input of each of the AND gates 75E, 76E, and is also connected to the input of a pulse generator 77E.

The charged voltage signal $M_e$ derived from the junction between the resistors 64E, 65E in the main circuit 541E is supplied to the input of a squaring circuit 144E, the output of which is connected to an input of a reciprocal circuit 145E. The output of the reciprocal circuit 145E is connected to the input of a voltage-to-frequency converter 72E, the output of which feeds the other input of the gate 75E and one input of AND gate 81E.

There is some reason to supply the charged voltage signal $M_e$ en route of the squaring circuit 144E and the reciprocal circuit 145E as well as the voltage-to-frequency converter 72E. Specifically, when the voltage across the main capacitor 1E (see FIG. 18) is high, the charged voltage signal $M_e$ obviously has an increased magnitude. Accordingly, the amount of flashlight produced per emission increases, and this allows a greater time interval between successive emissions. Hence, when the charged voltage signal $M_e$ is high, passing it through the reciprocal circuit 154E and the converter 72E allows the frequency of oscillation which is output from the converter 72E to be lowered, thus achieving an increased time interval between successive emissions. Conversely, when the voltage across the main capacitor 1E is reduced and the amount of flashlight per emission is reduced, the converter 72E produces a higher frequency of oscillation to reduce the time interval between successive emissions, thus maintaining a required exposure.

The output of the gate 75E is connected to the input of an emission interval controlling counter 85E, the output of which is connected to the input of a pulse generator 86E. The counter 85E enables a time interval between successive emissions to be established in accordance with a signal $x_{1e}$ supplied to the counter 85E. The output of the pulse generator 86E delivers the emission initiate signal $A_{5e}$, and is also connected to one input of OR gate 78E.

The other input of the gate 76E is connected to the output of an oscillator 84E which oscillates to provide pulses. Specifically, the oscillator 84E has a first input which is connected through a resistor 82E to a terminal to which the operating voltage Vcc is supplied, and also includes a second input which is connected through a capacitor 83E to the same terminal. The output of the gate 76E is connected to the input of a preset counter 78E which operates to control the total emission time in the dynamically flat emission mode in accordance with the signal $x_{2e}$ supplied thereto. The output of the counter 87E is connected to the input of a pulse generator 89E, the output of which is in turn connected to the input of an FF circuit 92E. The output of the FF circuit 92E feeds one input of AND gate 93E, the output of which in turn delivers a reset signal R which is fed to the reset terminals of the FF circuit 74E, the counters 85E, 87E as well as an FF circuit 161E and a preset counter 88E, which will be described later.

The output of the pulse generator 77E feeds the other input of the gate 78E, the output of which is connected to the input of an FF circuit 79E. The output of the FF circuit 79E feeds the other input of the gate 81E, the output of which is in turn connected to the input of a preset counter 88E which operates to establish a length of time from the initiation of emission of flashlight from the first flash discharge tube 2E to the initiation of emission of flashlight from the second flash discharge tube 151E in accordance with a signal $x_{3e}$ supplied thereto. The output of the counter 88E is connected to the input of a pulse generator 91E, the output of which delivers the emission initiate signal $A_{3e}$, and is also connected to the other input of AND gate 93E, to one input of AND gate 163E and to the reset terminal of the FF circuit 79E.

The output of the gate 163E is connected to the input of an FF circuit 161E and also delivers the trigger electrode signal $A_{4e}$. The output of the FF circuit 161E is connected through an inverter 162E to the other input of the gate 163E.

In operation, when a shutter release button, not shown, is depressed, the switch 159E which initiates the dynamically flat emission mode is closed, whereupon the transistor 69E which has been maintained conductive is turned off, thus allowing an H level signal to be applied to the input of the pulse generator 73E. The generator 73E then develops a pulse signal of H level at its output, which is delivered to the main circuit 541E (see FIG. 18) as the trigger electrode signal $A_{1e}$ and the emission initiate signal $A_{2e}$, and is also applied to the input of the FF circuit 74E. The FF circuit 74E then produces an output signal of H level, which is applied to the gates 75E, 76E to enable them. The output of the FF circuit 74E is also applied to the pulse generator 77E, causing the latter to develop a pulse signal which is applied to the gate 78E. The resulting H level signal from the gate 78E is applied to the FF circuit 79E, the output of which changes to its H level, which is applied to the gate 81E to enable it. Thus, when the FF circuit 74E produces an output signal of H level, all of the three AND gates 75E, 76E, 81E are enabled.

On the other hand, the main circuit 541E delivers the charged voltage signal $M_e$, which is applied to the squaring circuit 144E to be squared therein, and the reciprocal circuit 145E outputs a voltage which is inversely proportional to the square of the signal $M_e$. When the output from the reciprocal circuit 145E is applied to the converter 72E, the latter produces pulses of a frequency which depends on the magnitude of the voltage applied, for application to the AND gates 75E, 81E. Since the gate 81E is already enabled as mentioned previously, the pulses passes through the gate 81E to be applied to the preset counter 88E. When the counter counts a number of pulses which is equal to that established by the signal $x_{3e}$, it develops an H level signal, which is applied to the pulse generator 91E. The pulse generator 91E then delivers the emission initiate signal $A_{3e}$, which is also applied to the gate 163E. On the other hand, the FF circuit 161E initially provides an output signal of L level, which is inverted by the inverter 162E to be applied to the other input of the gate 163E as an H level signal. In other words, the gate 163E is initially enabled. Accordingly, the application of the emission initiate signal $A_{3e}$ thereto causes the gate 163E to output the trigger electrode signal $A_{4e}$. The output signal from the pulse generator 91E is also applied to the reset terminal of the FF circuit 79E, whereupon the output signal therefrom changes from its H level to its L level. The resulting L level signal is fed to the other input of the gate 81E, which is then disabled.

Since the gate 75E is also enabled, the pulses from the converter 72E pass through the gate 75E to be applied to the preset counter 85E. When a number of pulses which is equal to a count established by the signal $x_{1e}$ are applied, the counter 85E develops an output signal of H level which is applied to the input of the pulse generator 86E. The pulse generator 86E then delivers the emission initiate signal $A_{5e}$, which is then applied through the OR gate 78E to the input of the FF circuit 79E. Thereupon, the FF circuit 79E which has been delivering an L level output signal now delivers an H level signal to enable the gate 81E. Accordingly, a pulse train from the converter 72E passes through the gate 81E to be applied to the preset counter 88E.

Since the gate 76E is also enabled, the pulse train from the oscillator 84E passes through the gate 76E to be applied to the preset counter 87E. When it has received a number of pulses which is equal to a count established by the signal $x_{2e}$, the counter 87E develops an output signal of H level, which is applied to the pulse generator 89E. The pulse generator 89E then provides an output signal of H level, which is applied to the FF circuit 92E, causing the latter to output an H level signal. When applied to the AND gate 93E, this H level signal from the FF circuit 92E is effective in combination with the emission initiate signal $A_{3e}$, which is produced after a certain number of repetitions, to cause the gate 93E to produce an output signal of H level, which represents the reset signal R. The reset signal is applied to the reset terminals of the FF circuits 74E, 161E, 92E and the preset counters 85E, 87E, 88E, and accordingly, all of the emission initiate signals cease to be delivered. Thus, a series of emissions which constitute the dynamically flat emission mode terminate.

Figure 20:
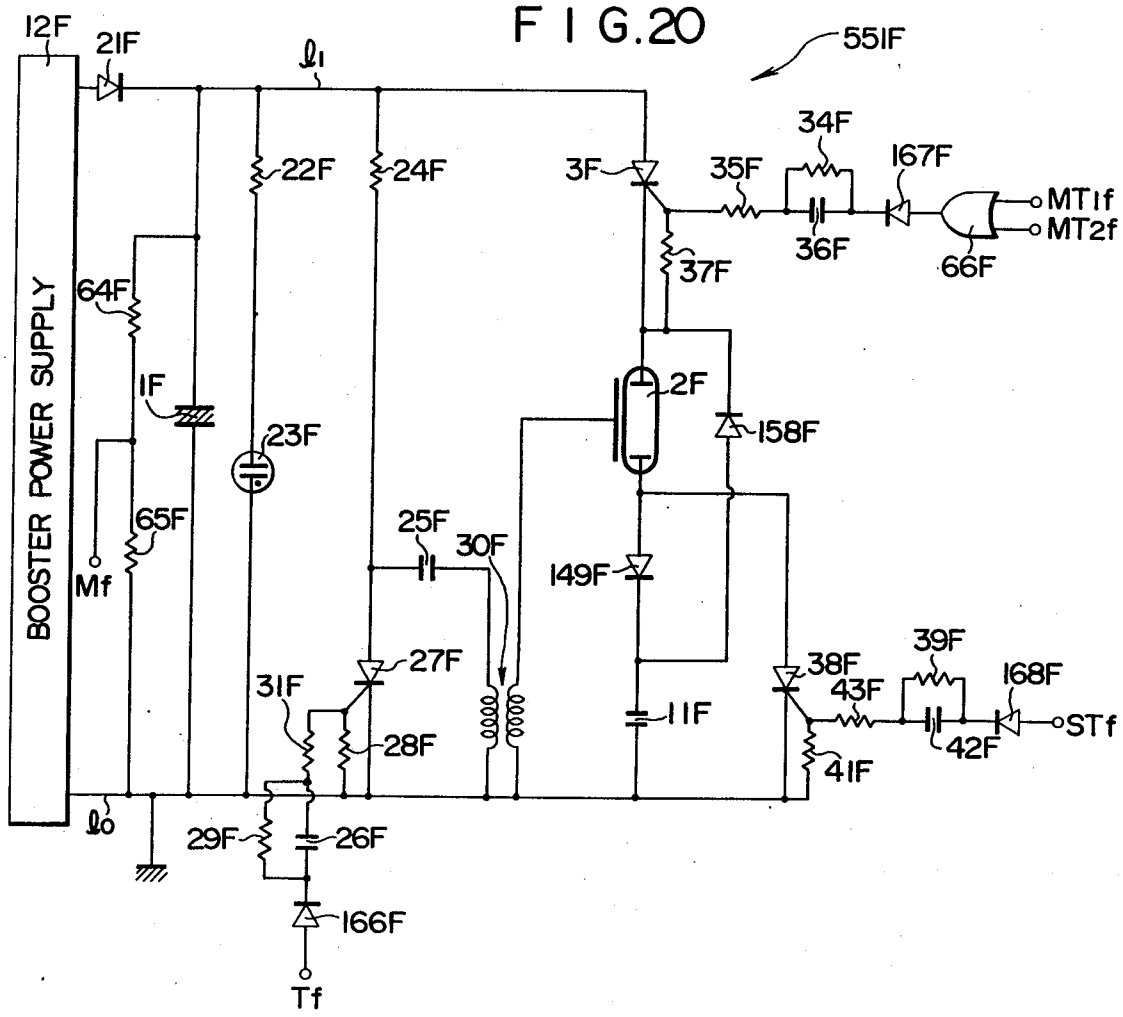
FIG. 20 is a circuit diagram of the main circuit of an electronic flash according to a fourth embodiment of the invention.
Figure 21:
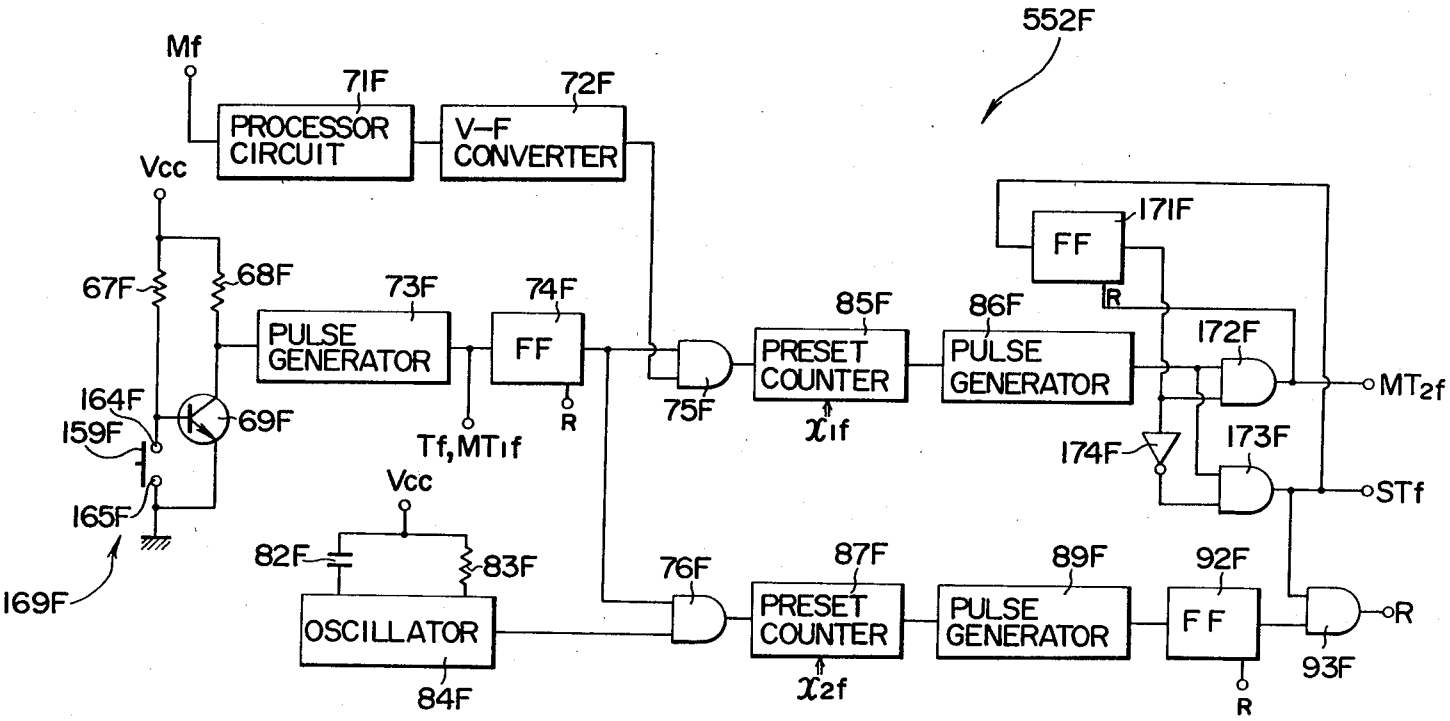
FIG. 21 is a circuit diagram of a control circuit which is connected to the main circuit shown in FIG. 20.

A fourth embodiment of the invention is shown in FIGS. 20 and 21. It comprises a main circuit 551F shown in FIG. 20 and a control circuit 552F shown in FIG. 21. Initially considering the main circuit 551F, it includes a booster power supply circuit 12F which may comprise a DC-DC converter of known form, for example. The positive terminal of the power supply circuit 12F is connected through a rectifier diode 21F to a positive bus $l_1$ and the negative terminal is connected to a negative bus $l_0$, which is connected to the ground.

Connected across the buses $l_1$, $l_0$ are a main capacitor 1F which provides a main source for the emission of flashlight, and a charging complete indicator circuit formed by a series combination of a resistor 22F and a neon lamp 23F. A voltage divider comprising a series combination of resistors 64F, 65F is also connected across these buses, and the junction between these resistors derives a charged voltage signal $M_f$ which is delivered to the control circuit 552F as will be described later.

Also connected across the buses $l_1$, $l_0$ is a series circuit including a resistor 24F and a thyristor 27F, with the junction therebetween being connected through a trigger capacitor 25F to one end of the primary coil of a trigger transformer 30F, the other end of which is connected to the ground. The gate of the thyristor 27F is connected to the ground through a resistor 28F, and is connected through a resistor 31F to one end of a parallel combination of resistor 29F and capacitor 26F, the other end of which is connected to the cathode of a diode 166F. The anode of the diode 166F is connected to receive a trigger signal $T_f$ which is delivered from the control circuit 552F as will be described later, the trigger signal being used to apply a trigger voltage to the trigger electrode of a flash discharge tube.

The trigger transformer 30F includes a secondary coil, one end of which is connected to the ground while the other end is connected to the trigger electrode of a flash discharge tube 2F. One electrode of the discharge tube 2F is connected to the cathode of a thyristor 3F and is also connected through a resistor 37F to the gate thereof, and is also connected to the cathode of a discharge diode 158F.

The anode of the thyristor 3F is connected to the bus $l_1$ while its gate is connected through a resistor 35F to one end of a parallel combination of resistor 34F and capacitor 36F, the other end of which is connected to the cathode of a diode 167F which has its anode connected to the output of OR gate 66F. The gate 66F includes one input to which a first main emission initiate signal $MT1_f$ delivered by the control circuit 662F is applied, and another input to which a second main emission initiate signal $MT2_f$ is similarly applied.

The other electrode of the flash discharge tube 2F is connected to the anode of a d.c. blocking diode 149F, the cathode of which is connected to the bus $l_0$ through an emission controlling capacitor 11F. The anode of the diode 149F is also connected to the anode of a discharge controlling thyristor 38F, the cathode of which is connected to the bus $l_0$. The gate of the thyristor 38F is connected through a resistor 43F to one end of a parallel combination of resistor 39F and capacitor 42F. The other end of the parallel combination is connected to the cathode of a diode 168F which is adapted to receive a sub-emission initiate signal $ST_f$ delivered from the control circuit 552F at its anode. The junction between the cathode of the diode 149F and the capacitor 11F is connected to the anode of the diode 158F.

In operation, when a power switch, not shown, is turned on, the main capacitor 1F is gradually charged, while simultaneously delivering the charged voltage signal $F_f$, representing the voltage across the capacitor 1F as divided by the resistors 64F, 65F, to the control circuit 552F. When the main capacitor 1F is charged to a given voltage, the neon lamp 23F is lit, indicating to an operator of a photographic camera that the electronic flash is capable of emitting flashlight. The trigger capacitor 25F is charged through a path $1_f$ indicated below.

positive terminal of main capacitor 1F→resistor 24F→trigger capacitor 25F→primary coil or trigger transformer 30F→negative terminal of main capacitor 1F path $1_f$ If now a trigger signal $T_f$ in the form of one-shot pulse is delivered from the control circuit 552F, the trigger signal $T_f$ is applied to the gate of the trigger thyristor 27F through a path $2_f$, indicated below, thus turning it on.

anode of diode 166F→capacitor 26F shunted by resistor 29F→resistor 31F→gate of thyristor 27F path $2_f$ When the thyristor 27F is turned on, the trigger capacitor 25F discharges through a path $3_f$, indicated below, to develop an induced voltage across the secondary coil of the trigger transformer 30F.

positive terminal of trigger capacitor 25F→trigger thyristor 27F→primary coil of trigger transformer 30F→negative terminal of trigger capacitor 25F path $3_f$ On the other hand, it will be noted that the voltage across the main capacitor 1F is applied across the series circuit comprising the main thyristor 3F, the flash discharge tube 2F, the diode 149F and the capacitor 11F. The first main emission initiate signal $MT1_f$ in the form of a one-shot pulse is delivered from the control circuit 552F at the same time as the trigger signal $T_f$ mentioned above, and is applied to one input of OR gate 66F, whereby the main thyristor 3F is turned on through a path $4_f$, indicated below.

one input of OR gate 66F→diode 167F→capacitor 36F shunted by resistor 34F→resistor 35F→gate of main thyristor 3F path $4_f$ Since the trigger voltage is already applied to the flash discharge tube 2F, there occurs a discharge current through the flash discharge tube 2F to emit flashlight, through a path $5_f$, indicated below.

positive terminal of main capacitor 1F→main thyristor 3F→flash discharge tube 2F→diode 149F→capacitor 11F→negative terminal of main capacitor 1F path $5_f$ The discharge current continues to flow until its magnitude reduces below the holding current level of the main thyristor 3F as a result of the progressive charging of the capacitor 11F, whereupon it ceases to flow, thus terminating a first emission of flashlight.

Subsequently when the sub-emission initiate signal $ST_f$ in the form of one-shot pulse is delivered from the control circuit 552F within the deionization time of the flash discharge tube 2F during which ions produced by the discharge remain therein, it is applied to the anode of the diode 168F to turn the thyristor 38F on through a path $6_f$, indicated below.

anode of diode 168F→capacitor 42F shunted by resistor 39F→resistor 43F→gate of thyristor 38F path $6_f$ Thereupon the emission controlling capacitor 11F discharges through a path $7_f$, indicated below, to cause a second emission of flashlight from the discharge tube 2F.

positive terminal of capacitor 11F→diode 158F→flash discharge tube 2F→thyristor 38F→negative terminal of capacitor 11F path $7_f$ When the capacitor 11F completely discharges through the path $7_f$, the thyristor 38F is turned off.

When the second main emission initiate signal $MT2_f$ in the form of one-shot pulse is delivered from the control circuit 552F and is applied to the other input of OR gate 66F within the deionization time, the main thyristor 3F is turned on again through the path $4_f$, thus causing the flash discharge tube 2F to emit flashlight while charging the capacitor 11F through the path $5_f$. When the charging of the capacitor 11F is completed, the main thyristor 3F is turned off. When subsequently the sub-emission initiate signal $ST_f$ is delivered from the control circuit 552F and is applied to the anode of the diode 168F, the thyristor 38F is turned on through the path $6_f$, whereby the capacitor 11F discharges through the path $7_f$, causing the flash discharge tube 2F to emit flashlight.

By repeating the described operation, the flash discharge tube 2F produces a succession of emissions of pulse-like flashlight. When a total emission time which is determined by the control circuit 552F passes, the sub-emission initiate signal $ST_f$ is applied eventually to discharge the capacitor 11F, thus terminating a series of emissions which constitute a dynamically flat emission mode.

It will be understood that this embodiment achieves an effective utilization of charge on the capacitor, which has been wastefully discharged in the prior art practice, to the emission of flashlight.

Referring to FIG. 21, the construction and operation of the control circuit 552F which is used to control the operation of the main circuit 551F will now be described. In FIG. 21, an initiation circuit 169F which initiates a dynamically flat emission mode of operation comprises a switch 159F having its one fixed contact 164F connected to the base of an NPN transistor 69F and also connected through a resistor 69F to a terminal to which the operating voltage Vcc is supplied. The other fixed contact 165F of the switch 195F is connected to the emitter of the transistor 69F and is also connected to the ground. The collector of the transistor 69F is connected to the terminal of operating voltage Vcc through a resistor 68F and is also connected to the input of a pulse generator 73F which is adapted to produce one-shot pulse of H level. The output of the pulse generator 73F delivers the trigger signal $T_f$ and the first main emission initiate signal $MT1_f$ in the form of one-shot pulses which are delivered to the main circuit 551F. The output of the pulse generator 73F is also connected to the input of an FF circuit 74F. The output of the FF circuit 74F feeds one input of each of AND gates 75F, 76F.

The charged voltage signal $M_f$ delivered from the main circuit 551F is supplied to the input of a processor circuit 71F which converts it into a signal which is inversely proportional to the voltage across the main capacitor 1F or the energy thereof. The output of the processor circuit 71F feeds a voltage-to-frequency converter 72F, the output of which in turn feeds the other input of the gate 75F. The output of the gate 75F is connected to the input of a preset counter 85F which establishes a time interval between pulse-like flashlight emissions in accordance with an input $x_{1f}$ supplied thereto. The output of the counter 85F is connected to the input of a pulse generator 86F, the output of which feeds one input of each of AND gates 172F, 173F. The other input of the gate 172F is connected to the output of an FF circuit 171F and also to the input of an inverter 174F. The output of the gate 173F delivers the sub-emission initiate signal $ST_f$ which is delivered to the main circuit 551F, and is also connected to the input of the FF circuit 171F and to one input of an AND gate 93F. The output of the gate 172F is connected to the reset terminal of the FF circuit 171F, and delivers the second main emission initiate signal $MT2_f$ to the main circuit 551F. The output of the inverter 174F feeds the other input of the gate 173F.

The other input of the gate 76F is connected to the output of an oscillator 84F having a pair of input terminals to which one end of each of a capacitor 82F and a resistor 83F are respectively connected, the other end of the capacitor 82F and the resistor 83F being connected together and connected to the terminal to which the operating voltage Vcc is supplied. The output of the gate 76F is connected to the input of a preset counter 87F which is operative to count pulses to a count which is established by an input $x_{2f}$ supplied thereto. The output of the counter 87F is connected to the input of a pulse generator 89F, the output of which is connected through an FF circuit 92F to the other input of the gate 93F. The output of the gate 93F delivers a reset signal R which is fed to the reset terminal of the FF circuits 74F, 92F.

In operation, when a power switch, not shown, is turned on, the operating voltage Vcc is supplied. If the switch 159F is now closed, an H level signal is applied to the input of the pulse generator 73F which has been maintained at its L level. Accordingly, the pulse generator 73F produces one-shot pulse which is fed to the FF circuit 74F, whereby the output thereof changes to its H level. Simultaneously, the pulse generator 73F delivers the trigger signal $T_f$ and the first main emission signal $MT1_f$ to the main circuit 551F. The H level output from the FF circuit 74F enables the gates 75F, 76F.

The charged voltage signal $M_f$ is supplied to the processor circuit 71F which then converts it into a signal which is inversely proportional to the voltage (energy) across the main capacitor 1F and feeds it to the converter 72F. It will be understood that the converter 72F provides a low frequency of oscillation when the charged voltage is high and provides a high frequency of oscillation when the charged voltage is low. In this manner, when the charged voltage is low, an increased number of emissions of pulse-like flashlight occur at a reduced time interval therebetween while when the charged voltage is high, a reduced number of emissions of pulse-like flashlight occur at a longer time interval, thereby assuring that a required amount of flashlight emitted be maintained.

Since the gate 75F is enabled, an output pulse train fed from the converter 72F can be supplied to the preset counter 85F, which then counts these pulses, and outputs an H level signal when the number of pulses reaches a given count which is established by the input $x_{1f}$. In response thereto, the pulse generator 86F provides a one-shot pulse, which is supplied to the gates 172F, 173F. On the other hand, the FF circuit 171F provides an output signal of L level, which is inverted by the inverter 174F to supply an H level signal to the gate 173F. Accordingly, the gate 173F delivers the sub-emission initiate signal $ST_f$ in the form of a one-shot pulse to the main circuit 551F. The one-shot pulse from the gate 173F is also applied to the FF circuit 171F, which provides an H level signal, fed to the gate 172F and the inverter 174F, thus enabling the gate 172F.

When a number of pulses which correspond to the input $x_{1f}$ are again fed to the preset counter 85F, there occurs an H level output signal from the pulse generator 86F, whereby the gate 172F delivers the second main emission initiate signal $MT2_f$ in the form of a one-shot pulse at its output which is delivered to the main circuit 551F, thus initiating a third emission of flashlight. Subsequently, the sub-emission initiate signal $ST_f$ and the second main emission initiate signal $MT2_f$ are alternately delivered to the main circuit 551F.

On the other hand, the gate 76F is enabled, and allows a pulse train from the oscillator 84F to be fed to the preset counter 87F. The counter 87F establishes a total emission time in accordance with the input $x_{2f}$, and when it has counted a number of pulses which corresponds to the input $x_{2f}$, it develops an output signal of H level, which causes the pulse generator 89F to supply a one-shot pulse to the FF circuit 92F, which then outputs an H level signal to cause the gate 93F to output the reset signal R when an H level signal is outputted from the gate 173F. The reset signal R is simultaneously supplied to the FF circuits 74F, 171F and 92F, thus resetting these FF circuits to their initial conditions. This completes a series of emissions which constitute a dynamically flat emission mode.

Figure 22:
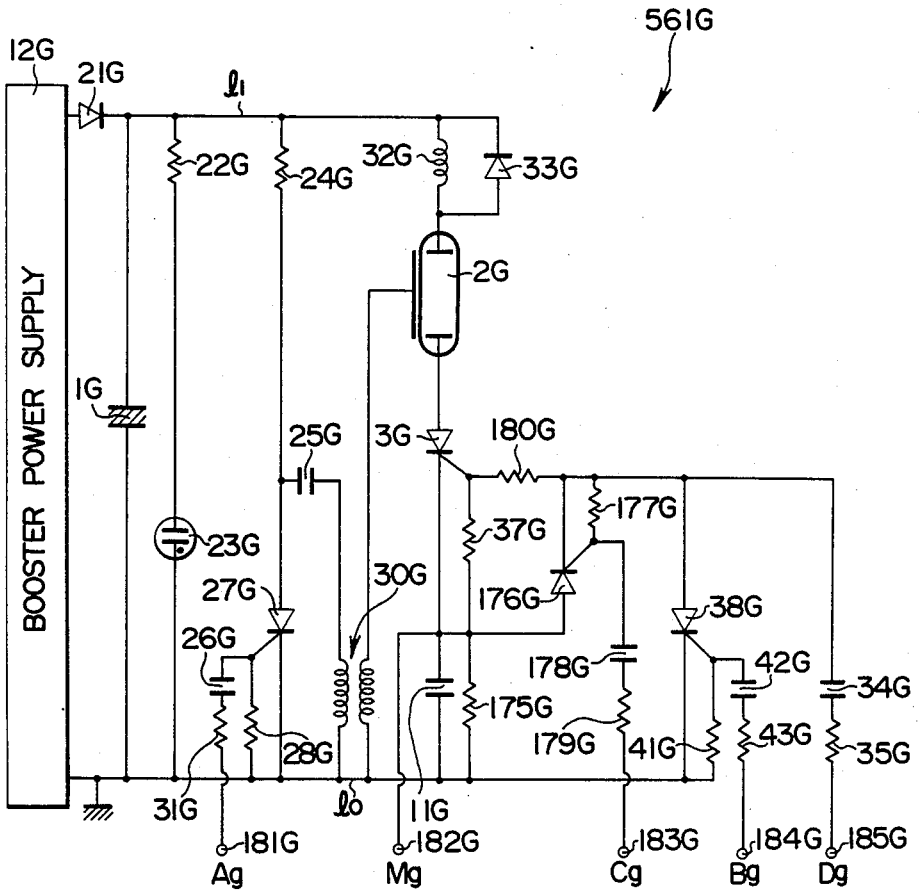
FIG. 22 is a circuit diagram of the main circuit of an electronic flash according to a fifth embodiment of the invention.
Figure 23:
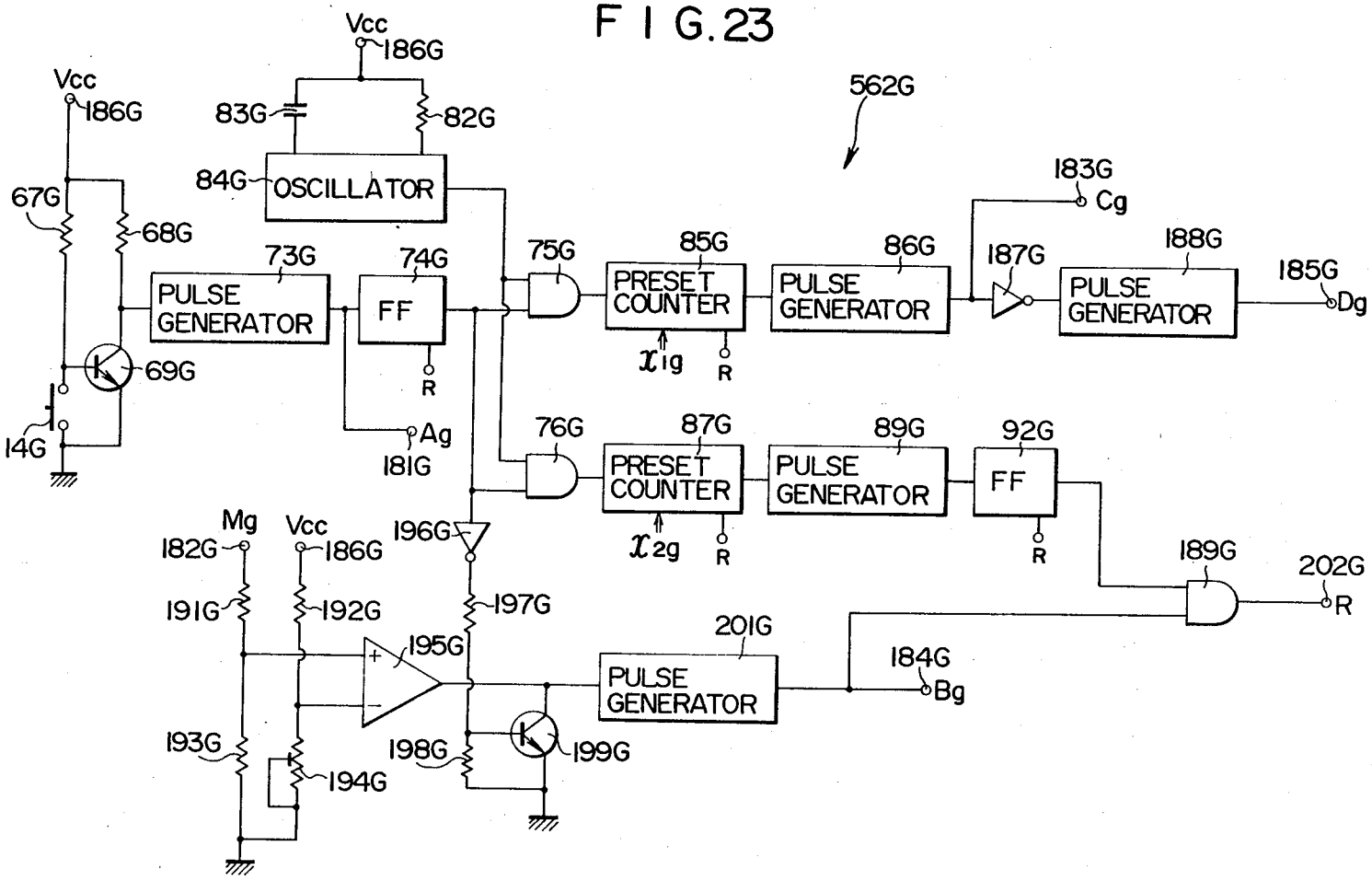
FIG. 23 is a circuit diagram of a control circuit which is connected to the main circuit shown in FIG. 22.

A fifth embodiment of the invention is shown in FIGS. 22 and 23. Specifically, this embodiment includes a main circuit 561G shown in FIG. 22 and a control circuit 562G shown in FIG. 23. It is a feature of this embodiment that a static induction thyristor which can be turned on and off by a bias voltage applied across the gate and the cathode thereof is used as a main switching element.

The present embodiment is constructed as an electronic flash which achieves a dynamically flat emission mode. Referring to FIG. 22, the main circuit 561G includes a booster power supply circuit 12G which may comprise a DC-DC converter of known form. The power supply circuit 12G has its negative terminal connected to a negative bus $l_0$ which is connected to the ground while the positive terminal of the circuit 12G is connected through a rectifier diode 21G to a positive bus $l_1$. A main capacitor 1G which provides a main source for the emission of flashlight is connected across the buses $l_1$, $l_0$, and a charging complete indicator circuit comprising a series combination of a resistor 22G and a neon lamp 23G connected across the buses. A series circuit including a resistor 24G, a trigger capacitor 25G and the primary coil of a trigger transformer 30G is also connected across the buses $l_1$, $l_0$, and the junction between the resistor 24G and the trigger capacitor 25G is connected to the anode of a trigger thyristor 27G, the cathode of which is connected to the bus $l_0$ and the gate of which is connected to the bus $l_0$ through a resistor 28G. The gate of the thyristor 27G is connected also through a series combination of a capacitor 26G and a resistor 31G to a connection terminal 181G, to which an emission initiate signal $A_g$ delivered by the control circuit 562G, to be described later, is supplied.

The trigger transformer 30G also includes a secondary coil, one end of which is connected to the bus $l_0$ while the other end is connected to the trigger electrode of a flash discharge tube 2G such as xenon discharge tube. The discharge tube 2G has its one electrode connected to the bus $l_1$ through a parallel combination of a diode 33G and a coil 32G which is effective to produce a progressive change in the rising and the falling edge of the discharge current through the discharge tube 2G. The other electrode of the discharge tube 2G is connected to the anode of a main thyristor 3G which comprises a static induction thyristor of normal-on type (hereafter referred to as SI thyristor). An emission controlling capacitor 11G is connected between the cathode of the main thyristor 3G and the bus $l_0$. The end of the capacitor 11G which is connected to the cathode of the main thyristor 3G is connected to a connection terminal 182G, which is adapted to deliver a signal $M_g$ representing the terminal voltage across the capacitor 11G to the control circuit 562G, as will be described later.

A resistor 37G is connected between the gate and the cathode of the main thyristor 3G, and the capacitor 11G is shunted by a resistor 175G. The gate of the main thyristor 3G is connected to one end of a resistor 180G, the other end of which is connected to the anode of a thyristor 38G and to the cathode of a thyristor 176G. The cathode of the thyristor 38G is connected to the bus $l_0$ while its gate is connected to the bus $l_0$ through a resistor 41G. The gate of the thyristor 38G is also connected through a series combination of a capacitor 42G and a resistor 43G to a connection terminal 184G, to which an emission terminate signal $B_g$ is applied from the control circuit 562G, as will be further described later. The thyristor 176G has its anode connected to the junction between the resistors 37G, 175G and its gate connected to its cathode through a resistor 177G. The gate of the thyristor 176G is also connected through a series combination of a capacitor 178G and a resistor 179G to a connection terminal 183G, to which a reemission prepare signal $C_g$ is supplied from the control circuit 562G, as will be described later. The other end of the resistor 180G is also connected through a series combination of a capacitor 34G and a resistor 35G to a connection terminal 185G, to which a reemission signal $D_g$ is supplied from the control circuit 562G, as will be described later.

The described main circuit 561G is connected to the control circuit 562G shown in FIG. 23. Referring to FIG. 23, there is shown a switch 14G which is used to initiate a dynamically flat emission mode of operation. The switch 14G has its one contact connected through a resistor 67G to a power supply terminal 186G and its other end connected to the ground. It is to be understood that the switch 14G is closed in response to the beginning of running of a first blind of a shutter or to the beginning of a film exposure. The junction between the switch 14G and the resistor 67G is connected to the base of an NPN transistor 69G, which has its emitter connected to the ground and its collector connected through a resistor 68G to the supply terminal 186G. The collector of the transistor 69G is connected to the input of a pulse generator 73G which is formed by a one-shot multivibrator. The output of the pulse generator 73G is connected to the connection terminal 181G from which the emission trigger signal $A_g$ is delivered to the main circuit 561G. The output of the pulse generator 73G is also connected to the set input (hereafter simply referred to as an input) of an RS-FF circuit 74G. The output of the FF circuit 74G feeds one input of each of AND gates 75G, 76G, and is also connected through a series combination of an inverter 196G and a resistor 197G to the base of an NPN transistor 199G. A resistor 198G is connected across the base and emitter of the transistor 199G, which has its emitter connected to the ground and its collector connected to the output of an operational amplifier 195G which defines a comparator. The amplifier 195G includes a non-inverting input which is connected to the junction between resistors 191G, 193G which are connected in series between the connection terminal 182G, to which the terminal voltage signal $M_g$ is applied from the main circuit 561G, and the ground. The amplifier 195G also includes an inverting input connected to the junction between a resistor 192G and a variable resistor 194G which are connected in series between the power supply terminal 186G and the ground. The purpose of the variable resistor 194G is to adjust the amount of flashlight produced per emission. The output of the amplifier 195G is connected to the input of a pulse generator 201G, which is also formed by a one-shot multivibrator, the output of which is connected to the connection terminal 184G from which the emission terminate signal $B_g$ is delivered to the main circuit 561G, and also feeds one input of AND gate 189G.

The other input of each of the gates 75G, 76G is connected to the output of an oscillator 84G including a resonant circuit comprising a capacitor 83G and a resistor 82G which have their one end connected to the power supply terminal 186G. The output of the gate 75G is connected to the input of a preset counter 85G which operates to count a time interval between successive emissions which constitute a dynamically flat emission mode of operation, in accordance with an input signal $x_{1g}$ supplied thereto. The counter 85G feeds its output to the input of a pulse generator 86G formed by a one-shot multivibrator. The output of the pulse generator 86G is connected to the connection terminal 183G from which the reemission prepare signal $C_g$ is delivered to the main circuit 561G, and is also connected through an inverter 187G to the input of a pulse generator 188G, also formed by a one-shot multivibrator. The output of the pulse generator 188G is connected to the connection terminal 185G from which the reemission signal $D_g$ is delivered to the main circuit 561G.

The output of the gate 76G is connected to the input of a preset counter 87G which operates to count a total emission time, namely, the time interval from the beginning of running of a first blind of a shutter to the end of running of second blind thereof during which a film is exposed, and which is determined by an input signal $x_{2g}$ supplied thereto. The output of the counter 87G feeds a pulse generator 89G formed by a one-shot multivibrator. The output of the generator 89G is connected to the pulse input of an FF circuit 92G, the output of which feeds the other input of the gate 189G. The output of the gate 189G develops a reset pulse R which is fed to the FF circuits 74G, 92G and the preset counters 85G, 87G to reset them.

The operation of the electronic flash according to the present embodiment in its dynamically flat emission mode will now be described. When the switch 14G is closed in response to a shutter release, the transistor 69G which has been maintained conductive is turned off, whereupon a signal which rises from L level to H level is applied to the pulse generator 73G, causing it to develop a pulse of H level which lasts for a brief time interval, thus delivering the emission trigger signal $A_g$ at the connection terminal 181G.

When the emission trigger signal $A_g$ is applied to the connection terminal 181G, it will be noted that in the main circuit 561G, a positive differentiated pulse is applied to the gate of the trigger thyristor 27G, turning it on. When the thyristor 27G is turned on, the trigger capacitor 25G is short-circuited through the primary coil of the trigger transformer 30G, and the resulting discharge develops a high voltage across the secondary coil of the trigger transformer 30G, which high voltage is applied to the trigger electrode of the discharge tube 2G to excite it. Since the main thyristor 3G comprises SI thyristor of normal-on type, when the flash discharge tube 2G is excited, the main capacitor 1G discharges through a path including the coil 32G, discharge tube 2G, main thyristor 3G and capaitor 11G, causing the discharge tube 2G to begin the emission of flashlight.

The output pulse from the pulse generator 73G is also applied to the FF circuit 74G, which then develops an output of H level. Thereupon, the gates 75G anbd 76G are enabled to pass a pulse train of a given frequency from the oscillator 84G therethrough to be applied to the preset counters 85G, 87G, which then begin counting the number of such pulses.

The output pulse from the FF circuit 74G is also applied, through the inverter 196G in series with the resistor 197G, to the base of the transistor 199G, thereby changing it from its conductive to its nonconductive condition. As a consequence, the output level from the amplifier 195G can be applied to the pulse generator 201G.

When the discharge tube emits flashlight and the discharge current flows through the capacitor 11G, the latter capacitor is charged by the discharge current, whereby the terminal voltage signal $M_g$ appearing at the connection terminal 182G increases gradually. At the terminal voltage signal $M_g$ increases, the voltage applied to the non-inverting input of the amplifier 195G exceeds a value established by the variable resistor 194G and applied to the inverting input thereof, thereby causing the amplifier 195G to produce an output of H level which is then applied to the pulse generator 201G. In response thereto, the pulse generator 201G develops a pulse of H level and having a reduced duration. This pulse is applied to the connection terminal 184G as the emission terminate signal $B_g$.

In response to the emission terminate signal $B_g$ applied to the connection terminal 184G in the main circuit 561G, a differentiated pulse is applied to the gate of the thyristor 38G to turn it on. The capacitor 11G then discharges through a path including the resistor 37G, resistor 180G, thyristor 38G and returning to the bus $l_0$, and the resulting discharge current passing through the resistor 180G applies back bias across the gate and cathode of the main thyristor 3G to turn it off. When the main thyristor 3G is turned off, the discharge current ceases to flow through the discharge tube 2G, and thus the emission of flashlight is terminated.

It will be seen that the amount of flashlight produced per emission from the discharge tube 2G can be adjusted by means of the variable resistor 194G. Specifically, if the variable resistor 194G is adjusted to provide an increased resistance, the reference voltage applied to the inverting input of the amplifier 195G rises, with result that the occurrence of the emission terminate signal $B_g$ is delayed, resulting in an increased amount of flashlight emitted. Conversely, a reduced resistance of the variable resistor 194G results in a reduced amount of flashlight emitted. In this manner, the emission of flashlight from the discharge tube 2G can be terminated in response to the detection of an arbitrary magnitude of the signal $M_g$ as it rises when the capacitor 11G is charged during the emission of flashlight. Accordingly, the amount of flashlight produced per emission can be made dependent on a particular diaphragm value or film speed, by adjusting the variable resistor 194G in accordance with such diaphragm value or film speed, for example.

The counter 85G begins counting output pulses from the oscillator 84G when the emission is initiated, and when a time interval has passed which corresponds to a particular time interval between successive emissions and which is determined by the input signal $x_{1g}$, it outputs a single pulse of H level and having a short duration. When the counter 85G has produced such pulse, it again begins counting the output pulses from the oscillator 84G. In response to the output pulse from the counter 85G, the pulse generator 86G develops a pulse of H level and having a short duration, which pulse is applied to the connection terminal 183G as the reemission prepare signal $C_g$. When the reemission prepare signal $C_g$ is applied to the connection terminal 183G, it will be seen that in the main circuit 561G, a positive differentiated pulse is applied to the gate of the thyristor 176G to turn it on. The thyristor 176G then short-circuits the series combination of resistors 37G, 180G, whereby the capacitor 11G instantaneously discharges through a path including the thyristor 176G, thyristor 38G and returning to the bus $l_0$ The resulting discharge of the capacitor 11G reduces the current flow through the thyristors 38G, 176G below their holding current levels, thereby turning them off.

The output pulse from the generator 86G is fed through the inverter 187G, whereby the falling, trailing edge of the output pulse from the generator 86G is inverted by the inverter 187G to cause the following pulse generator 188G to develop an output pulse of H level, which is delayed by the duration of the output pulse from the generator 86G and which represents the reemission signal $D_g$ applied to the connection terminal 185G.

In response to the reemission signal $D_g$ applied to the connection terminal 185G, it will be seen that in the main circuit 561G, a positive differentiated pulse is applied to the gate of the main thyristor 3G to turn it on. By choosing the time interval from the termination of emission from the discharge tube 2G in response to the emission terminal signal $B_g$ to the application of the reemission signal $D_g$ to the gate of the main thyristor 3G to be less than the deionization time of the discharge tube 2G, it is possible to pass the discharge current of the main capacitor 1G through the discharge tube 2G, causing it to resume the emission of flashlight. The resulting discharge current charges the capacitor 11G again, and accordingly the described operation is repeated subsequently.

When the discharge tube 2G is caused to repeat the emission of flashlight at a time interval between successive emissions which is determined by the preset counter 85G and when the total emission time determined by the preset counter 82G passes, or when the second blind of the shutter has run, the counter 87G develops an output of H level, which causes the pulse generator 89G to develop a brief pulse of H level, thus triggering the FF circuit 92G. Subsequently, when the pulse generator 201G produces a pulse of H level which represents the emission terminate signal $B_g$, it passes through the gate 189G which is already enabled by the output from the FF circuit 92G, thus developing the reset pulse R of H level at the reset terminal 202G. This reset pulse R is applied to the FF circuits 74G, 92G and the preset counters 85G, 87G to reset them. When the counter 85G is reset, the reemission prepare signal $C_g$ is no longer produced, and a discharge loop for the capacitor 11G which comprises a path including the capacitor 11G, resistors 37G, 180G, thyristor 38G and returning to the capacitor 11G is maintained. The time constant of the capacitor 11G and the resistors 37G, 180G in the discharge loop is determined to be greater than the deionization time of the discharge tube 2G, thus preventing the discharge tube 2G from resuming the emission of flashlight if the capacitor 2G has been completely discharged through the resistors 37G, 180G and the thyristor 38G is cut off.

Subsequent to the completion of the operation in the dynamically flat emission mode, any remaining charge on the capacitor 11G completely discharges through the resistor 175G. The resistance of the resistor 175G is chosen to be sufficiently large to prevent any adverse influence upon the time constant formed by the capacitor 11G and the resistors 37G, 180G. It will be understood that the thyristor 176G may be replaced by a transistor.

Figure 24:
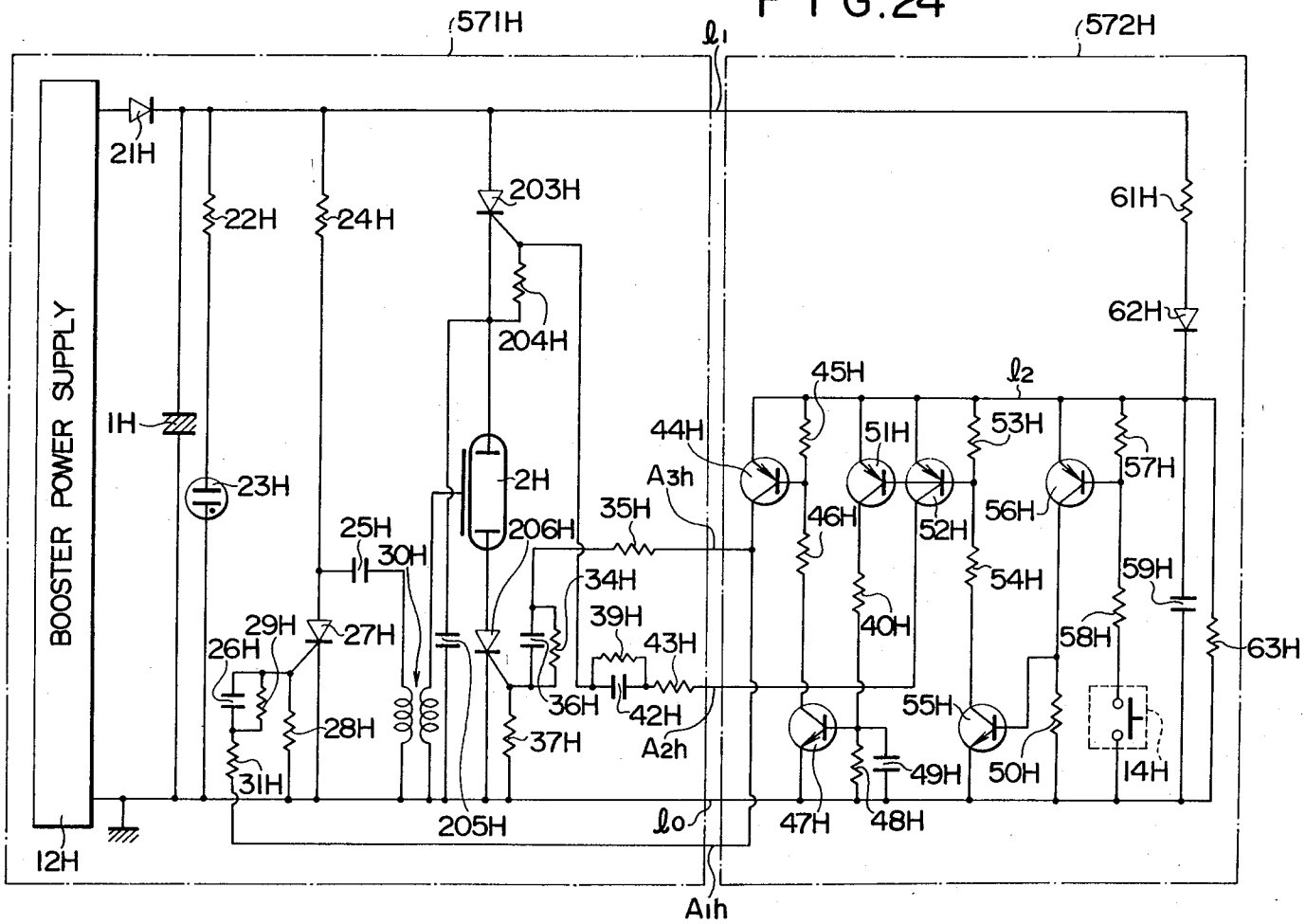
FIG. 24 is a circuit diagram of an electronic flash according to a sixth embodiment of the invention.

A sixth embodiment of the invention is shown in FIG. 24. In the first to the fifth embodiment described above, the charging current of the respective emission controlling capacitor or capacitors has been what has caused an emission of flashlight from the flash discharge tube. However, in the present embodiment, an emission controlling capacitor is initially charged, and its discharge current is utilized to cause an emission of flashlight from the flash discharge tube.

Referring to FIG. 24, the electronic flash of the present embodiment comprises a main circuit 571H and a control circuit 572H, both shown in respective phantom line blocks. As before, the main circuit 571H includes a booster power supply circuit 12H which converts the voltage of a source battery to a higher voltage. The negative terminal of the circuit 12H is connected to a negative bus $l_0$ which is connected to the ground while the positive terminal is connected through a rectifier diode 21H to a positive bus $l_1$. Connected across the buses $l_1$, $l_0$ are a main capacitor 1H; a charging complete circuit of known form which comprises a series combination of a resistor 22H and a neon lamp 23H; and a trigger circuit of known form including resistors 24H, 28H, 29H, 31H, a trigger capacitor 25H, a capacitor 26H, a trigger thyristor 27H and a trigger transformer 30H. It is to be noted that the resistor 31H is connected to receive an emission trigger signal $A_{1h}$ which is delivered from the control circuit 572H.

A first switching element or first thyristor 203H has its anode connected to the bus $l_1$ and its cathode connected to the bus $l_0$ through an emission controlling capacitor 205H. The cathode of the thyristor 203H is also connected to the anode of a second switching element or second thyristor 206H through a flash discharge tube 2H, the cathode of the thyristor 206H being connected to the bus $l_0$. A bias resistor 204H is connected across the gate and cathode of the first thyristor 203H, and the gate of the thyristor 203H is connected through a parallel combination of a capacitor 42H and a resistor 39H in series with a resistor 43H to receive a charging controlling signal $A_{2h}$ which is delivered from the control circuit 572H. A bias resistor 37H is connected across the gate and cathode of second thyristor 206H, and the gate of the thyristor 206H is connected through a parallel combination of a capacitor 36H and a resistor 34H in series with a resistor 35H to receive an emission initiate signal $A_{3h}$ which is delivered from the control circuit 572H.

Considering now the control circuit 572H, a series circuit including a resistor 61H, a diode 62H which prevents a back flow, and a resistor 63H is connected across the buses $l_1$, $l_0$. The junction between the cathode of the diode 62H and the resistor 63H is connected to a low voltage bus $l_2$. A capacitor 59H is connected across the buses $l_2$, $l_0$ to serve as a power supply. A series circuit including a resistor 57H, a resistor 58H and synchronizing contacts 14H is connected across the buses $l_2$, $l_0$. The synchronizing contacts 14H are contained within a photographic camera, and are formed by a switch which is closed when the shutter is fully open.

The junction between resistors 57H, 58H is connected to the base of a PNP transistor 56H which has its emitter connected to the bus $l_2$ and its collector connected through a resistor 50H to the bus $l_0$ and also connected to the base of an NPN transistor 55H. The transistor 55H has its emitter connected to the bus $l_0$ and its collector connected to the bus $l_2$ through series resistors 54H, 53H. The junction between the resistors 54H, 53H is connected to the bases of PNP transistors 52H, 51H, which have their emitters connected to the bus $l_2$. The collector of the transistor 52H delivers the discharge control signal $A_{2h}$ to the main circuit 571H. The collector of the transistor 51H is connected to the bus $l_0$ through a resistor 40H in series with a parallel combination of a resistor 48H and an integrating capacitor 49H. The junction between the resistor 40H and the integrating capacitor 49H, or the integrator output is connected to the base of an NPN transistor 47H, which has its emitter connected to the bus $l_0$ and its collector connected to the bus $l_2$ through series resistors 46H, 45H. The junction between the resistors 46H, 45H is connected to the base of a PNP transistor 44H, which has its emitter connected to the bus $l_2$ and its collector connected to deliver the emission trigger signal $A_{1h}$ and the emission initiate signal $A_{3h}$ to the main circuit 571H.

The operation of the electronic flash of the present embodiment will now be described with reference to FIG. 6 where it is presumed that the synchronizing contacts 14C stands for synchronizing contacts 14H and the signals $A_{1c}$, $A_{2c}$ and $A_{3c}$ stand for the signals $A_{1h}$, $A_{2h}$ and $A_{3h}$, respectively.

When the synchronizing contacts 14H are closed at the same time as the shutter of a photographic camera becomes fully open, the base potential of the transistor 56H which has been maintained at its H level by the resistor 57H now changes to its L level, whereby the transistor 56H is turned on. This raises the base potential of the transistor 55H to turn it on, and this in turn causes the transistors 52H, 51H to be turned on. Accordingly the collector of the transistor 52H assumes its H level, which is applied, as the charging control signal $A_{2h}$, to the gate of the first thyristor 203H to turn it on.

When the first thyristor 203H is turned on, the emission controlling capacitor 205H is charged through a path starting from the bus $l_1$ and including the first thyristor 203H and the emission controlling capacitor 205H and returning to the bus $l_0$. As the charging operation is completed, the current flow through the thyristor 203H reduces below its holding current level, whereby the thyristor 203H is turned off. Since the transistor 51H is turned on at the same time as the charging control signal $A_{2h}$ rises to its H level or as the transistor 52H is turned on, the capacitor 49H begins integrating the voltage on the bus $l_2$ through the resistor 40H. Subsequently, when the integrated voltage across the capacitor 49H exceeds a threshold value across the base and emitter of the transistor 47H, which may be 0.6 V, for example, the transistor 47H is turned on. It is to be understood that a delay time $\tau$ which is required for the integrated voltage to exceed the threshold value is chosen to be equal to or greater than a time interval which is required to charge the emission controlling capacitor 205H. When the transistor 47H is turned on, the base of the transistor 44H assumes its L level, and this transistor becomes conductive. When the transistor 44H becomes conductive, the collector thereof rises to its H level, which is applied as the emission trigger signal $A_{1h}$, to the gate of the trigger thyristor 27H to turn it on. This causes the trigger capacitor 25H which is already charged through a path including the bus $l_1$, resistor 24H, trigger capacitor 25H, the primary coil of trigger transformer 30H and returning to the bus $l_0$ to discharge, producing a discharge current which passes through the primary coil of the transformer 30H. A high voltage is then developed across the secondary coil of the transformer 30H to trigger the discharge tube 2H.

At the same time, the second thyristor 206H is turned on by the emission initiate signal $A_{3h}$ which rises to its H level. When the second thyristor 206H is turned on, the emission controlling capacitor 205H which is already charged discharges through the discharge tube 2H, thus initiating the emission of flashlight therefrom. The emission continues until the emission controlling capacitor 205H discharges to reduce the current flow through the second thyristor 206H below its holding current level, whereupon this thyristor 206H is turned off. Subsequently, the described operation is repeated for each closure of the synchronizing contacts 14H or in response to each shutter release operation.

Figure 25:
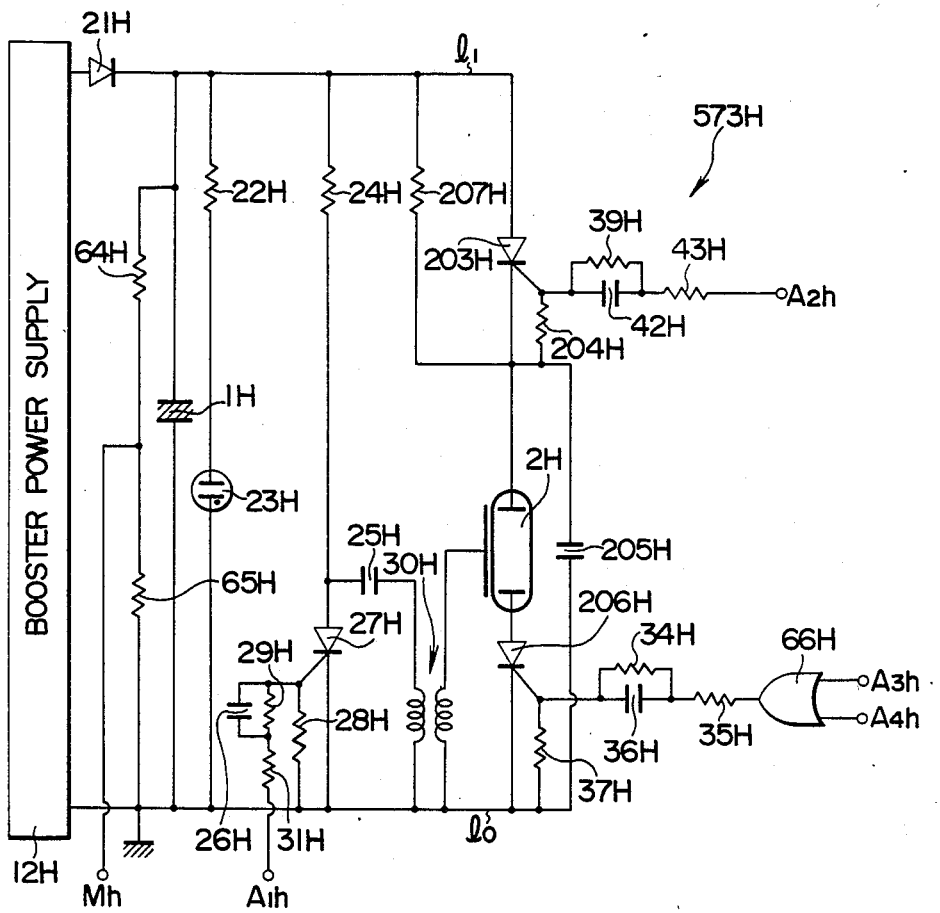
FIG. 25 is a circuit diagram of the main circuit of an electronic flash which represents a modification of the electronic flash shown in FIG. 24.

A modification of the embodiment shown in FIG. 24 is illustrated in FIG. 25. This embodiment includes a main circuit 573H which is used to provide a dynamically flat emission mode of operation. The main circuit 573H may be combined with the control circuit 512C shown in FIG. 8, and its operation will be described with reference to FIG. 9.

The main circuit 573H shown in FIG. 25 is generally similar to the main circuit 571H shown in FIG. 14 with certain additions. Specifically, a voltage divider including resistors 64H, 65H is connected across the main capacitor 1H, and the junction therebetween delivers a monitored voltage signal $M_h$ which is delivered to the control circuit 512C (see FIG. 8). In addition, a resistor 207H is connected across the anode and the cathode of the first thyristor 203H to achieve a gradual charging of the emission controlling capacitor 205H. Furthermore, the resistor 35H which has its one end connected through the resistor 34H to the gate of the second thyristor 206H has its other end connected to the output of an OR gate 66H, to which an emission initiate signal $A_{3h}$ and an emission reinitiate signal $A_{4h}$, both delivered from the control circuit 512C, are supplied.

As mentioned above, the main circuit 573H may be combined with the control circuit 512C shown in FIG. 8, but it should be noted that there is a difference in the type of operation in that one is used to cause an emission of flashlight as the emission controlling capacitor is charged while the other is used to cause an emission of flashlight as the emission controlling capacitor discharges. Accordingly, the signal $A_{2c}$, which functions to control the discharge operation in the arrangement of FIG. 8, has the function of controlling the charging operation in the present modification. Also, the preset counter 88C, which functioned to control the timing of discharge in the arrangement of FIG. 8, has the function of controlling the timing of charging in the present modification.

The operation of the modification shown in FIG. 25 will now be described with reference to a series of timing charts shown in FIG. 9. In response to a shutter release, a first blind of a shutter begins to run, closing the synchronizing contacts 70C. This brings the base of the transistor 69C to its L level, whereby this transistor is turned off. When the transistor 69C is turned off, a signal which rises to H level is applied to the trigger input of the pulse generator 73C, thus triggering it to develop one-shot pulse of H level. This pulse is applied as the emission trigger signal $A_{1h}$, to the gate of the trigger thyristor 27H to turn it on. When the thyristor 27H is turned on, the flash discharge tube 2H is triggered in the same manner as mentioned before. The H level output from the pulse generator 73C is also applied, as the emission initiate signal $A_{3h}$ through the OR gate 66H to the gate of the second thyristor 206H to turn it on. It is to be understood that the emission controlling capacitor 205H has now been completely charged through a path including the bus $l_1$, resistor 207H, emission controlling capacitor 205H and returning to the bus $l_0$. Accordingly, when the second thyristor 206H is turned on, the emission of flashlight from the discharge tube 2H is initiated by the discharge of the emission controlling capacitor 205H. At the same time, the FF circuit 74C is set by the H level output from the pulse generator 73C, thus enabling the gates 75C, 76C. In addition, the H level output from the FF circuit 74C triggers the pulse generator 77C, which then develops a one-shot pulse of H level at its output. This output pulse passes through the gate 78C to set the FF circuit 79C, the output of which changes to its H level to enable the gate 81C.

The voltage across the main capacitor 1H as divided by the voltage dividers 64H, 65H is supplied to the processor circuit 71C as the monitored voltage signal $M_h$. The processor circuit 71C converts it into a voltage which is inversely proportional to the square of the voltage across the capacitor 1H. The resulting voltage is converted into a pulse train $P_h$ having a frequency which is proportional to an input voltage, by the converter 72H. The pulse train $P_h$ is fed through the gate 75C to the preset counter 85C which controls the time interval between successive emissions, and is also fed through the gate 81C to the preset counter 88C which controls the timing of the discharge operation. In addition, the preset counter 87C begins counting output pulses from the oscillator 84C until the total emission time previously established is reached.

When the discharge current of the emission controlling capacitor 205H through the discharge tube 2H has reduced the current flow through the second thyristor 206H below its holding current level, this thyristor is turned off to terminate the emission. Subsequently when the counter has counted a number of pulses in the pulse train $P_h$ which corresponds to the input signal $x_{3h}$, the counter 88C develops an output of H level. This triggers the pulse generator 91C, which then develops a one-shot pulse of H level, which is applied as the charging controlling signal $A_{2h}$ to the gate of the first thyristor 203H to turn it on. This allows the emission controlling capacitor 205H, which discharged through the discharge tube 2H, to be rapidly charged through the first thyristor 203H in preparation for the next following emission.

Simultaneously, the one-shot pulse from the pulse generator 91C resets the FF circuit 79C, the output of which returns to its L level to disable the gate 81C, whereby the pulse train $P_h$ ceases to be fed to the preset counter 88C.

Subsequently, when the preset counter 85C has counted a number of pulses in the pulse train $P_h$ which corresponds to the input signal $x_{1h}$, this counter provides an output of H level, which resets the counter 85C and also triggers the pulse generator 86C. In response thereto, the generator 86C develops one-shot pulse of H level, which is applied as the emission reinitiate signal $A_{4h}$, through the OR gate 66H to the gate of the second thyristor 206H to turn it on. When the second thyristor 206H is turned on, the emission controlling capacitor 205H discharges through the discharge tube 2H, which then initiates the emission of flashlight. At the same time, the one-shot pulse from the pulse generator 86C is fed through the OR gate 78C to set the FF circuit 79C, the output of which reverts to its H level to enable the gate 81C again, whereby the pulse train $P_h$ is fed to the preset counter 88C again, thus allowing its counting operation.

Subsequently, pulses of H level which sequentially occur in the charging control signal $A_{2h}$ and the emission reinitiate signal $A_{4h}$ cause the flash discharge tube 2H to repeat successive emissions of flashlight. The time interval between successive emissions is long for a high voltage and is short for a low voltage across the main capacitor 1H. In this manner, because the amount of flashlight produced per emission reduces in a gradual manner as the voltage across the main capacitor 1H reduces, the time interval between successive emissions is gradually shortened, thus maintaining the effective amount of emission constant.

Subsequently, when the number of pulses fed to the counter 87C which controls the total emission time reaches a count which corresponds to the input signal $x_{2h}$, the counter 87C develops an output of H level. This output triggers the pulse generator 89C, which sets the FF circuit 92C and enables the gate 93C. The gate 93C produces the reset signal R as a pulse of H level in the charging control signal $A_{3c}$ has passed therethrough, thus resetting the various parts of the circuit and completing a series of successive emissions which constitute the dynamically flat emission mode of operation.

It will be appreciated that the time interval between successive emissions must be chosen less than the deionization time of the flash discharge tube 2H.

What is claimed is:

1. An electronic flash, comprising;

a first switching element connected in a discharge loop of a main capacitor for charging an emission control capacitor with charge from the main capacitor;

a second switching element connected in shunt with the emission controlling capacitor to form a discharge loop therefor;

a flash discharge tube connected in series with a selected one of the first and the second switching elements to emit flashlight as a selected one of the first and the second switching elements conducts;

a trigger circuit for exciting the flash discharge tube in cooperation with the shutter release operation of a camera; and an emission control circuit for applying a control signal to first and the second switching element at a predetermined time subsequent to the occurence of the synchronizing signal.

2. An electronic flash according to claim 1 in which a series circuit including the flash discharge tube, the first switching element and the emission controlling capacitor is connected in the discharge loop of the main capacitor.

3. An electronic flash according to claim 2, further including means for producing an emission initiate signal which turns the first switching element on; and means for producing a discharge control signal which turns the second switching element on when the first switching element is off.

4. An electronic flash according to claim 3, further including means which causes a single emission of flashlight from the flash discharge tube.

5. An electronic flash according to claim 3, further including means for receiving an emission initiate signal which causes a first emission of flashlight by turning the first switching element on and for receiving an emission reinitiate signal which causes a second and a subsequent emission of flashlight; and means for receiving a discharge control signal which precedes the emission reinitiate signal for discharging the emission controlling capacitor which is charged as a result of turning the second switching element on.

6. An electronic flash according to claim 3, further including said trigger circuit including a trigger capacitor;

means for receiving a signal which causes the trigger capacitor to discharge, means for receiving a first trigger signal which excites the flash discharge tube by charging the trigger capacitor;

means for receiving a second trigger signal which excites the flash discharge tube by causing the trigger capacitor to discharge;

means for receiving an emission initiate signal which causes a first emission of flashlight by turning the first switching element on; and means for receiving a discharge control signal which is effective to discharge the emission controlling capacitor which is charged as a result of turning the second switching element on.

7. An electronic flash according to claim 2, further including an inductance and the second switching element being connected in the discharge loop of the emission controlling capacitor.

8. An electronic flash according to claim 7, further including means for receiving an emission initiate signal which turns the first switching element on; and means for receiving emission reinitiate signals which occur at a given time interval after the emission initiate signal for turning said first switching element on at subsequent intervals.

9. An electronic flash according to claim 7, further including a series circuit comprising the flash discharge tube, the first switching element, an inductance and the emission controlling capacitor;

means for preventing the first switching element from being turned on when the second switching element is turned on;

means for receiving an emission trigger signal which excites the flash discharge tube;

means for receiving an emission initiate signal which turns the first switching element on; and means for receiving an emission reinitiate signal which occurs at a given time interval after the emission initiate signal for turning said first switching element on at subsequent intervals.

10. An electronic flash according to claim 2, further including a first series circuit associated with the main capacitor and including at least a first flash discharge tube, the first switching element and the emission controlling capacitor; and a second series circuit associated with the emission controlling capacitor and including at least a second flash discharge tube and the second switching element.

11. An electronic flash according to claim 10, further including means for exciting the first flash discharge tube when a first emission trigger signal is received and for exciting the second flash discharge tube when a second emission trigger signal is received;

means for receiving a first and a second emission initiate signal which causes an emission of flashlight from the first flash discharge tube; and means for receiving a third emission initiate signal which causes an emission of flashlight from the second flash discharge tube.

12. An electrdnic flash according to claim 2, further including a first rectifier connected in the series circuit; and a second rectifier in combination with the second switching element which defines the discharge loop for the emission controlling capacitor.

13. An electronic flash according to claim 12, further including means for receiving a first emission initiate signal which occurs simultaneously with the emission trigger signal and which turns the first switching element on and for receiving a second emission initiate signal which causes a third and a subsequent odd-numbered emission of flashlight; and means for receiving a third emission initiate signal which causes an even-numbered emission of flashlight from the flash discharge tube as a result of causing the discharge of the emission controlling capacitor.

14. An electronic flash according to claim 2, in which the first switching element comprises a static induction thyristor.

15. An electronic flash according to claim 14, further including means for delivering a signal representing a terminal voltage across the emission controlling capacitor;

means for receiving an emission terminate signal which occurs upon detecting that a given amount of flashlight has been produced as a result of the emission of flashlight from the flash discharge tube;

means for receiving a reemission prepare signal which causes any remaining charge on the emission controlling capacitor to discharge; and means for receiving a reemission signal which causes a reemission of flashlight from the flash discharge tube.

16. An electronic flash according to claim 1, further including a series circuit connected in the discharge loop of the main capacitor and including the first switching element and the emission controlling capacitor; and another series circuit including the flash discharge tube and the second switching element and which defines the discharge loop for the emission controlling capacitor.

17. An electronic flash according to claim 16, further including means for receiving a charging control signal which charges the emission controlling capacitor by turning the first switching element on; and means for receiving an emission initiate signal which causes an emission of flashlight from the flash discharge tube by turning the second switching element on to discharge the emission controlling capacitor after the latter has been charged.

18. An electronic flash according to claim 16, further including means for receiving a charging control signal which occurs at periodic intervals to charge the emission controlling capacitor; and means for receiving a first discharge control signal which occurs only once and precedes the charging control signal for discharging the emission controlling capacitor and for receiving an emission reinitiate signal which occurs at a periodic interval after the charging control signal for causing an emission of flashlight from the flash discharge tube.

19. A method for operating an electronic flash comprised of a main capacitor, a series circuit coupled across the main capacitor and including a flash tube having a trigger electrode, a first switching eleemnt and an emission control capacitor, and a second switching element coupled across the discharge control capacitor, said method comprising the steps of:

closing said first switching element and pulsing said trigger electrode to ignite the flash tube whereupon the discharge control capacitor is caused to charge and subsequently turn-off the first switching element when the discharge control capacitor is substantially fully charged.

20. The method of claim 19 wherein the first switch is a thyristor adapted to turn off when the current therethrough falls below the holding current of the thyristor due to the charging of the emission control capacitor.

21. A method for operating an electronic flash comprised of a main capacitor, a series circuit coupled across the main capacitor and including a flash tube having a trigger electrode, a first switching element and an emission control capacitor, and a second switching element coupled across the discharge control capacitor, said method comprising the steps of:

closing said first switching element and pulsing said trigger electrode to ignite the flash tube whereupon the discharge control capacitor is caused to charge and subsequently turn-off the first switching element when the discharge control capacitor is substantially fully charged;

closing said second switching element to discharge said discharge control capacitor and thereafter closing said first switching element at a time interval after opening of the first switch which is less than the deionization time of said flash tube to reignite said flash tube.

22. A method for operating a electronic flash comprised of a main capacitor, a trigger circuit including a trigger capacitor, a first switch coupled across the trigger circuit, a second switch coupled between the main capacitor and the trigger circuit, a series circuit coupled across the main capacitor and including a flash tube having a trigger input coupled to said trigger circuit, a third switch and an emission control capacitor, and a fourth switch connected across the emission control capacitor, the method comprising the steps of:

normally maintaining the first switch turned on to prevent charging of the trigger capacitor;

turning off the first switch and turning on the second switch to permit the trigger capacitor to be charged by the main capacitor;

turning on the second and third switches to cause the trigger capacitor to ignite the flash tube whereupon the ignited flash tube and the on state of the third switch enable charging of the emission control capacitor by said main capacitor until the third switch is turned off as a result of the charging of said emission control capacitor;

turning on said fourth switch to discharge said control capacitor and thereafter turning on said third switch at a time prior to deionization of the flash tube whereupon the flash tube is reignited to again charge the emission control capacitor.

23. A method for operating an electronic flash comprised of a main capacitor, a series circuit coupled across the main capacitor and including a flash tube having a trigger electrode, a first switching element having a control input and an emission control capacitor, a second switch coupled across the emission control capacitor, an inductance coupled between the first and second switches;

a trigger circuit coupled to said main capacitor and a third switch coupled to said trigger circuit, a second series circuit coupled between the control input of the emission control capacitor, said method comprising the steps of:

closing said third switch to cause said trigger circuit to ignite the flash tube;

closing the first switch to charge the control capacitor from said main capacitor whereupon said first switch is opened when said control capacitor is fully charged;

closing the second switch to discharge said control capacitor and simultaneously causing the inductance coupled between the first and second switches to develop an electromotive force to establish a current flow through the second series circuit coupled between the emission control capacitor and the control input of the first switch to automatically turn on the first switch before deionization of the flash tube.

24. A method for operating an electronic flash comprised of a main capacitor, a series circuit coupled across the main capacitor and including a flash tube having a trigger electrode, a first switching element having a control input and an emission control capacitor, a second switch coupled across the emission control capacitor, an inductance coupled between the first switch and the emission control capacitor;

a trigger circuit coupled to said main capacitor and a third switch coupled to said trigger circuit, a second series circuit coupled between the control input of the emission control capacitor, said method comprising the steps of:

closing said third switch to cause said trigger circuit to ignite the flash tube;

closing the first switch to charge the control capacitor from said main capacitor whereupon said first switch is opened when said control capacitor is fully charged;

closing the second switch to discharge said control capacitor and simultaneously causing the inductance coupled between the first and second switches to develop an electromotive force to establish a current flow through the second series circuit coupled between the emission control capacitor and the control input of the first switch to automatically turn on the first switch before deionization of the flash tube.

25. A method for operating an electronic flash comprising a main capacitor, a common series circuit coupled to the main capacitor and comprised of an emission control capacitor and a first switch, second and third series circuits having first ends coupled to said main capacitor and second ends coupled to said common series circuit and each being comprised of a flash tube having a trigger electrode and a diode connected so that the polarities of said diodes in said second and third series circuits are reversed, and a second switch forming a closed-loop path with one of said second and third series circuits and said emission control capacitor, said method comprising the steps of:

turning on said first switch and pulsing the trigger electrode of the flash tube in said second series circuit for charging the emission control capacitor from said main capacitor, whereupon the first switch is turned off when the emission control capacitor is substantially fully charged;

closing said second switch and pulsing the trigger electrode of the flash tube in the third series circuit whereupon the emission control capacitor is discharge through said second series circuit and said second switch.

26. The method of claim 25 further comprising the steps of turning on said first switch and reigniting the flash tube in the second series circuit by pulsing the trigger electrode of the last mentioned flash tube after said emission control capacitor has discharged through said third series circuit and said second switch, whereupon the emission control capacitor is again charged by said main capacitor.

27. A method for operating an electronic flash comprised of a main capacitor, a series circuit coupled to said main capacitor and including a first switch, a flash tube having a trigger electrode, a first diode and an emission control capacitor, a second diode coupled across said flash tube and said first diode, and a second switch coupled across said first diode and said emission control capacitor, said method compirsing the steps of:

turning on said first switch and igniting said flash tube by pulsing its trigger electrode whereupon the emission control capacitor is charged by said main capacitor and said first switch is subsequently turned off when said emission control capacitor is fully charged;

turning on said second switch prior to the deionization time of said flash tube whereupon the emission control capacitor discharges through said second diode, said flash tube and said second switch, said second switch being turned off when said emission control capacitor is substantially fully discharged.

28. The method of claim 27 further comprising the steps of turning on said first switch prior to the deinonization time of the flash tube whereupon said emission control capacitor is again charged by said main capacitor and the first switch is subsequently turned off when said emission control capacitor is substantially fully charged.

29. A method for operating an electronic flash comprised of a main capacitor, a series circuit coupled to said main capacitor including a flash tube having a trigger electrode, a first switch having a control element and an emission control capacitor, a second switch coupled between the emission control capacitor and a control input of the first switch and a third switch coupled across said emission control capacitor, said first switch being a normally-on static induction type thyristor, an impedance element coupled between the second switch and the control element of the first switch, said method comprising the steps of:

igniting said flash tube by pulsing its trigger electrode whereupon the emission control capacitor is charged by the main capacitor through the flash tube and the normally-on first switch, said first switch being turned off when said emission control capacitor is substantially fully charged;

turning on said second switch when the emission control capacitor is charge to a predetermined level to discharge said emission control capacitor and to turn off said first switch by means of the impedance element coupled between the second switch and the control element of the first switch;

turning on said second switch to short-circuit said impedance element and causing the emission control capacitor to instantaneously discharge through the second and third switches;

turning on said first switch at a time interval prior to the deionization time of the flash tube.

30. A method for operating an electronic flash comprising of a main capacitor, a series circuit coupled to said main capacitor and including a first switch, a flash tube having a trigger electrode and a second switch, and a second capacitor coupled across said flash tube and said second switch, said method comprising the steps of:

(a) turning on said first switch for charging said second capacitor by said main capacitor whereupon the first switch is turned off when the second capacitor is substantially fully charged;

(b) turning on said second switch and igniting said flash tube by pulsing its trigger electrode to cause said second capacitor to be discharged through the flash tube and second switch, said second switch being turned off when said emission control capacitor is substantially discharged.

31. The method of claim 30 further comprising repeating steps (a) and (b) in response to each shutter release operation.

32. A method for operating an electronic flash comprised of a main capacitor, a series circuit coupled to the main capacitor and including a first switch, a flash tube having a trigger electrode and a second switch, an impedance element coupled across the first switch and an emission control capacitor coupled across the flash tube and second switch and being initially charged by said impedance element, said method comprising the steps of:

igniting said flash tube by pulsing its trigger electrode and turning on said second switch for discharging the emission control capacitor through the flash tube and second switch, said second switch being turned off when said emission control capacitor is substantially discharged;

turning on said first switch for instantaneously charging said emission control capacitor from said main capacitor through said first switch, said first switch being turned off when said emission control capacitor is substantially charged;

turning on said second switch before the deionization time of said flash tube to discharge said emission control capacitor through said flash tube and said second switch, said second switch being turned off when said emission control capacitor is substantially discharged.

33. An electronic flash, comprising:

a power source;

a flash discharge tube coupled to the power source and having a trigger input;

a series circuit comprising a trigger coil and a trigger capacitor coupled to said trigger input for exciting the flash discharge tube;

a first switching element interposed within a discharging loop including said trigger capacitor and said flash discharge tube;

a second switching element coupled to said power source for allowing said trigger capacitor to be rapidly charged from said power source; and control signal generator means for alternately rendering said first and second switching elements conductive.

34. An electronic flash according to claim 33, in which a series circuit comprising a resistor and a third switching element is connected in parallel with said first switching element, said control signal generating means further comprising means to render the third switching element conductive prior to a flashlight emission.

35. An electronic flash, comprising:

a flash discharge tube disposed within a discharging loop to receive charge stored across a main capacitor;

a subcapacitor of smaller capacity than said flash discharge tube for controlling the flashlight emission from said tube;

control means including first and second silicon-controlled rectifiers coupled to said subcapacitor to provide charging and discharging loops for respectively charging and discharging said subcapacitor;

an inductor disposed within at least one of said charging and discharging loops of said subcapacitor; and a transmission path for transmitting a counter charge and discharge signal of said subcapacitor to the gate of at least one of said first and second silicon-controlled rectifiers, said last-mentioned signal being generated by the action of said inductor when charging and discharging said subcapacitor.

36. An electronic flash, comprising:

a main capacitor;

a series circuit comprising a flash discharge tube and a subcapacitor of smaller capacity than said main capacitor which are disposed within a discharging loop for said main capacitor;

a trigger circuit for said flash discharge tube; and a discharging loop including said subcapacitor and a switching element for discharging charge which has been stored across said subcapacitor during a first emission of said flash discharge tube whereby said flash discharge tube provides a second emission as said subcapacitor is discharging.

37. An electronic flash, comprising:

a main capacitor for storing charge derived from a power source;

a flash discharge tube disposed within a discharging loop of said main capacitor;

a trigger circuit for initiating a flashlight emission of said flash discharge tube;

control means having a first operating state for interrupting the discharging current of said main capacitor which flows through said flash discharge tube and contributes to a flashlight emission; and flashlight emission control means for operating the control means to a second operating state to reinitiate the flow of discharging current to said flash discharge tube within the deionization time of said flash discharge tube.

38. An electronic flash according to claim 37 wherein means are provided for repeatedly alternating said control means between said first and second operating states.

39. An electronic flash, comprising:

a main capacitor for storing charge derived from a power source;

a series circuit comprising a flash discharge tube, a first switching element and a subscapacitor which are disposed within a discharging loop of said main capacitor, said subcapacitor having a smaller capacity than that of said main capacitor;

a second switching element disposed in parallel with said subcapacitor; and signal generator means for generating a control signal which alternately renders said first and second switching elements conductive.

40. An electronic flash according to claim 39, in which said signal generator means alternately generates the control signal within the deionization time of said flash discharge tube.

41. An electronic flash, comprising:

a main capacitor for storing charge derived from a power source;

a series circuit comprising a flash discharge tube and a first switching element which are disposed within a discharging loop of said main capacitor;

a subcapacitor which is capable of being charged with the discharging current through said first switching element and which is also capable of discharging the charge to said flash discharge tube, said subcapacitor having a smaller capacity than that of said main capacitor; and a second switching element disposed within a discharging loop including said subcapacitor and said flash discharge tube.

42. An electronic flash according to claim 41 in which means coupled to said first and second switching elements is provided to render the first and second switching elements conductive within the deionization time of said flash discharge tube.

43. An electronic flash according to claim 42 in which said last-mentioned means includes means for repeatedly alternating the conductive states of said first and second switching elements.

* * * * *

UNITED STATES PATENT AND TRADEMARK OFFICE

CERTIFICATE OF CORRECTION

PATENT NO. : 4,677,347

DATED : June 30, 1987

INVENTOR(S) : Hiroaki Nakamura

It is certified that error appears in the above-identified patent and that said Letters Patent is hereby corrected as shown below:

Column 8, line 68, before "AND" insert --the--.

Column 10, line 17, before "one-" insert --a--.

Column 16, line 50, after "resistor" insert --142D--.

Column 31, line 51, before "generator" insert --pulse--.
line 52, delete "pulse".

Column 33, line 28, change "$l_0$" to --$l_0$. --.

UNITED STATES PATENT AND TRADEMARK OFFICE

CERTIFICATE OF CORRECTION

PATENT NO. : 4,677,347

DATED : June 30, 1987

INVENTOR(S) : Hiroaki Nakamura

It is certified that error appears in the above-identified patent and that said Letters Patent is hereby corrected as shown below:

Claim 1, Column 39, line 5, before "first" insert --the--.

Claim 12, Column 40, line 38, change "electrdnic" to --electronic--.

Claim 25, Column 43, line 44, change "discharge" to --discharged--.

Claim 28, Column 44, line 8, change "deinonization" to --deionization--.

Claim 29, Column 44, line 33, change "charge" to --charged--.

Claim 39, Column 46, line 32, change "subscapacitor" to --subcapacitor--.

Signed and Sealed this

Twelfth Day of April, 1988

*Attest:*

DONALD J. QUIGG

*Attesting Officer*

*Commissioner of Patents and Trademarks*